US009701499B2

(12) United States Patent
Shoji et al.

(10) Patent No.: US 9,701,499 B2
(45) Date of Patent: Jul. 11, 2017

(54) SHEET FEEDER, IMAGE FORMING APPARATUS INCORPORATING THE SHEET FEEDER, AND METHOD OF REMOVING DISCHARGE PRODUCTS IN THE IMAGE FORMING APPARATUS

(71) Applicants: Kaoru Shoji, Kanagawa (JP); Manabu Nonaka, Kanagawa (JP)

(72) Inventors: Kaoru Shoji, Kanagawa (JP); Manabu Nonaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/064,724

(22) Filed: Mar. 9, 2016

(65) Prior Publication Data

US 2016/0272444 A1 Sep. 22, 2016

(30) Foreign Application Priority Data

Mar. 17, 2015 (JP) ..... 2015-053328

(51) Int. Cl.
*B65H 5/00* (2006.01)
*B65H 3/18* (2006.01)
*G03G 15/00* (2006.01)

(52) U.S. Cl.
CPC ..... *B65H 5/004* (2013.01); *B65H 3/18* (2013.01); *G03G 15/6529* (2013.01); (Continued)

(58) Field of Classification Search
CPC .... B65H 5/004; B65H 3/18; B65H 2515/716; B65H 2406/20; B65H 2301/44334; (Continued)

(56) References Cited

U.S. PATENT DOCUMENTS 5,219,154 A 6/1993 Fukube et al.
7,731,348 B2 * 6/2010 Mitsuhashi ..... B41J 29/17 271/193

(Continued)

FOREIGN PATENT DOCUMENTS

EP 1918115 A2 5/2008
JP H10109775 A 4/1998

(Continued)

OTHER PUBLICATIONS

European Office Action mailed Aug. 5, 2016.
Extended European Search Report dated Nov. 17, 2016.

*Primary Examiner* — Patrick Cicchino
(74) *Attorney, Agent, or Firm* — Harness, Dickey & Pierce, P.L.C.

(57) ABSTRACT

A sheet feeder, which is incorporated in an image forming apparatus, includes an attraction body disposed facing a bundle of sheets, a charger to charge the attraction body to electrostatically attract an uppermost sheet of the bundle of sheets to the attraction body, a liquid supplier to supply a liquid to dissolve discharge products to the attraction body, and a liquid remover to remove the liquid from the attraction body. Further, a method of removing discharge products includes counting the number of sheets fed from a sheet container, determining that the number of sheets reaches a predetermined threshold value, confirming that a current time falls within a predetermined period of time or receiving a turn off signal to turn off a power supply, removing the discharge products from a surface of an attraction body, and resetting the number of sheets or further turning off the power supply.

17 Claims, 14 Drawing Sheets

(52) U.S. Cl.
CPC ..... *B65H 2301/44334* (2013.01); *B65H 2301/5133* (2013.01); *B65H 2301/5322* (2013.01); *B65H 2406/20* (2013.01); *B65H 2515/716* (2013.01)

(58) Field of Classification Search
CPC .... B65H 2301/5133; B65H 2301/5322; G03G 15/6529
USPC ..... 271/18.1, 193
See application file for complete search history.

(56) References Cited

U.S. PATENT DOCUMENTS

| | | | | |
|---|---|---|---|---|
| 8,042,797 | B2 * | 10/2011 | Fujimori | B65H 3/06 271/97 |
| 2008/0107461 | A1 * | 5/2008 | Miyata | B41J 11/007 399/343 |
| 2010/0118097 | A1 * | 5/2010 | Ichinose | B65H 5/004 347/104 |
| 2010/0296851 | A1 | 11/2010 | Toyooka et al. | |
| 2011/0024971 | A1 | 2/2011 | Toyooka et al. | |
| 2011/0052227 | A1 | 3/2011 | Toyooka et al. | |
| 2011/0062651 | A1 | 3/2011 | Higaki et al. | |
| 2011/0062655 | A1 | 3/2011 | Togashi et al. | |
| 2011/0121506 | A1 | 5/2011 | Ishikawa et al. | |
| 2011/0204557 | A1 | 8/2011 | Ishikawa et al. | |
| 2011/0204558 | A1 | 8/2011 | Takahashi et al. | |
| 2012/0061903 | A1 | 3/2012 | Eguchi et al. | |
| 2012/0061904 | A1 | 3/2012 | Higaki et al. | |
| 2012/0170960 | A1 | 7/2012 | Nishida et al. | |
| 2012/0228817 | A1 | 9/2012 | Kobayashi et al. | |
| 2012/0230745 | A1 | 9/2012 | Kobayashi et al. | |
| 2012/0235346 | A1 | 9/2012 | Ikeda et al. | |
| 2013/0142539 | A1 | 6/2013 | Komiyama et al. | |
| 2013/0161894 | A1 | 6/2013 | Ishikawa et al. | |
| 2014/0001699 | A1 * | 1/2014 | Ishikawa | B65H 3/18 271/18.1 |
| 2014/0070479 | A1 | 3/2014 | Toyooka et al. | |
| 2014/0312557 | A1 | 10/2014 | Ishikawa et al. | |

FOREIGN PATENT DOCUMENTS

| | | |
|---|---|---|
| JP | 2002-091260 | 3/2002 |
| JP | 2002-162881 | 6/2002 |
| JP | 2004-130719 | 4/2004 |
| JP | 2011-063391 | 3/2011 |

* cited by examiner

SHEET FEEDER, IMAGE FORMING APPARATUS INCORPORATING THE SHEET FEEDER, AND METHOD OF REMOVING DISCHARGE PRODUCTS IN THE IMAGE FORMING APPARATUS

CROSS-REFERENCE TO RELATED APPLICATIONS

This patent application is based on and claims priority pursuant to 35 U.S.C. §119(a) to Japanese Patent Application No. 2015-053328, filed on Mar. 17, 2015, in the Japan Patent Office, the entire disclosure of which is hereby incorporated by reference herein.

BACKGROUND

Technical Field

This disclosure relates to a sheet feeder, an image forming apparatus incorporating the sheet feeder, and a method of removing discharge products in the image forming apparatus.

Related Art

Various types of sheet feeders are known to be included in an image forming apparatus. Such an image forming apparatus has a configuration in which an electrostatic sheet attraction and separation system generates an electric field on a charged target belt so that the charged target belt contacts an uppermost sheet that is placed on top of a bundle of sheets to attract and separate the uppermost sheet from the charged target belt.

A comparative sheet feeder having such an electrostatic sheet attraction and separation and separation system includes a dielectric belt that is a charged target member wound around two rollers, a charger that contacts the dielectric belt, and an electric charge applier that applies an alternating voltage to the charger to apply an alternating electric charge to the dielectric belt.

Prior to a sheet feeding operation, the dielectric belt is separated from the bundle of sheets. When the uppermost sheet is separated from the bundle of sheets to be fed from a sheet container or a sheet tray, the dielectric belt is rotated before being applied with an alternating electric charge via a charging blade. The alternating electric charge is uniformly applied to the dielectric belt, the rotation of the dielectric belt is stopped. Thereafter, the dielectric belt is moved toward the bundle of sheets. Then, the dielectric belt contacts the uppermost sheet of the bundle of sheets so that the uppermost sheet of the bundle of sheets is attracted to the dielectric belt.

When the uppermost sheet of the bundle of sheets is attracted to a surface of the dielectric belt that is placed on an upper face of the bundle of sheets, the dielectric belt is moved in a direction to separate from the bundle of sheets, so that the uppermost sheet attracted to the dielectric belt is separated from the bundle of sheets. When rotation of the dielectric belt starts, the uppermost sheet attracted to the dielectric belt is conveyed toward a pair of sheet conveying rollers that is a sheet holder.

Generally, proximity electrical discharge is generated between a charging member and the dielectric belt so as to apply an alternating electric charge to the dielectric belt. The proximity electrical discharge produces discharge products such as nitrogen oxide, and therefore the discharge products adhere to the dielectric belt. Then, as discharge products accumulates on the surface of the dielectric belt due to long use of the dielectric belt, the dielectric belt becomes more difficult to be charged, and therefore a sheet becomes more difficult to be electrostatically attracted to the dielectric belt.

SUMMARY

At least one aspect of this disclosure provides a sheet feeder including an attraction body disposed facing an upper surface of a bundle of sheets including an uppermost sheet, a charger disposed above the attraction body to charge a surface of the attraction body such that the attraction body electrostatically attracts the uppermost sheet of the bundle of sheets, a liquid supplier to supply a liquid to the attraction body, the liquid to dissolve discharge products, and a liquid remover to remove the liquid supplied by the liquid supplier from the attraction body.

Further, at least one aspect of this disclosure provides an image forming apparatus including a sheet container to accommodate the bundle of sheets, an image forming device to form an image on the uppermost sheet fed from the sheet container, and the above-described sheet feeder to separate the uppermost sheet from the bundle of sheets in the sheet container and supply the uppermost sheet to the image forming device.

Further, at least one aspect of this disclosure provides a method of removing discharge products including counting the number of sheets fed from a sheet container, determining that the number of sheets fed from the sheet container reaches a predetermined threshold value, confirming that a current time falls within a predetermined period of time, removing the discharge products from a surface of an attraction body, and resetting the number of sheets fed from the sheet container.

Further, at least one aspect of this disclosure provides a method of removing discharge products including counting the number of sheets fed from a sheet container, determining that the number of sheets fed from the sheet container reaches a predetermined threshold value, receiving a turn off signal to turn off a power supply, removing the discharge products from a surface of an attraction body, resetting the number of sheets fed from the sheet container, and turning off the power supply.

DETAILED DESCRIPTION

Figure 1:
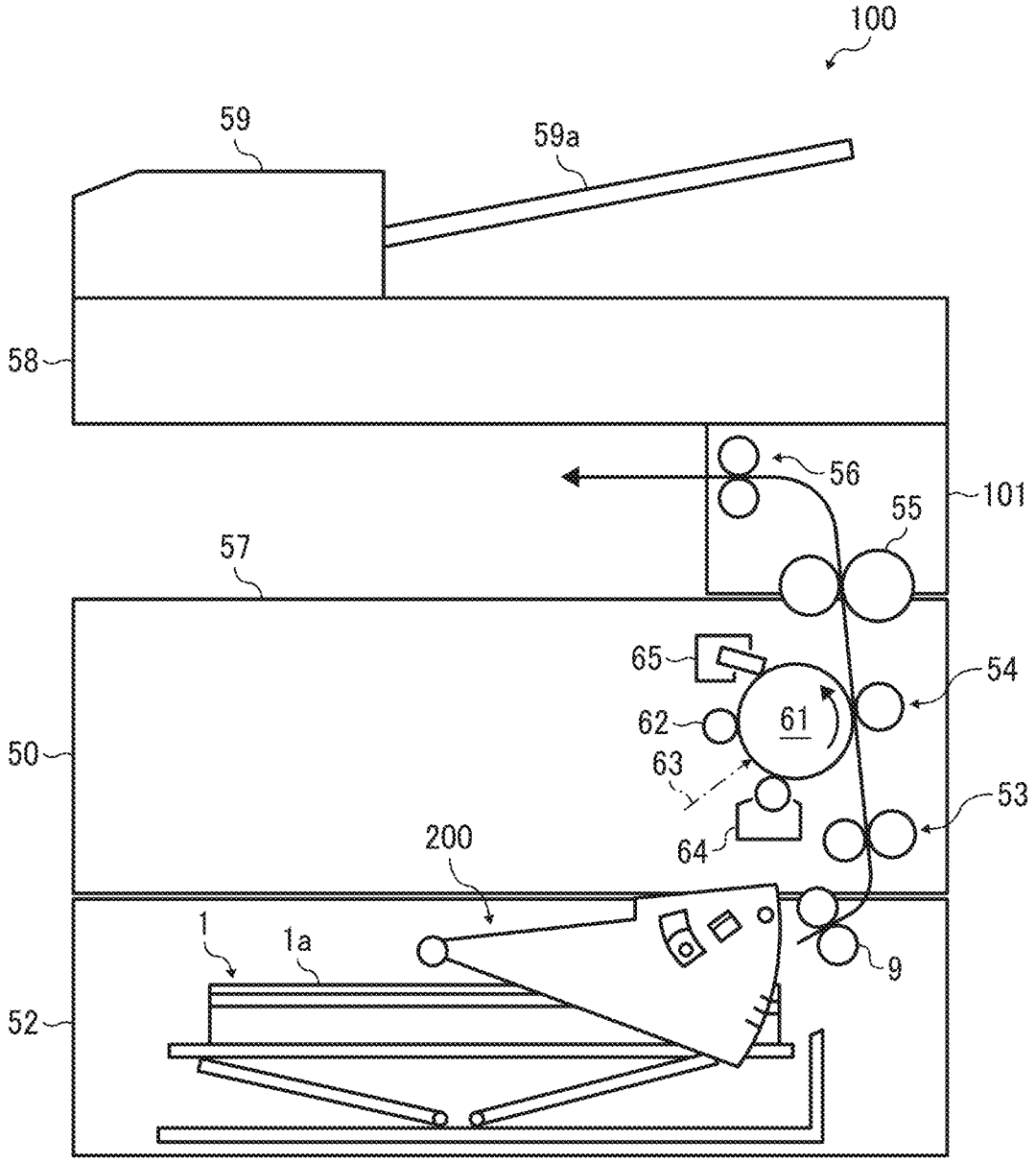
FIG. 1 is a diagram illustrating an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below" "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred examples of this disclosure are described.

Now, a description is given of an electrophotographic image forming apparatus 100 according to an example of this disclosure.

It is to be noted that this disclosure is not limited to the image forming apparatus 100 according to the present examples but is also applicable to any image forming apparatuses such as an inkjet type image forming apparatus.

It is to be noted that identical parts are given with identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

A description is given of a configuration of the image forming apparatus 100 according to an example of this disclosure, with reference to FIG. 1.

In FIG. 1, the image forming apparatus 100 includes an automatic document feeder (ADF) 59, an original document reader 58, an image forming device 50, and a sheet feeding device 52. The document reader 58, the sheet feeding device 52, and the image forming device 50 are accommodated in an apparatus body 101.

The ADF 59 is mounted on the document reader 58. The ADF 59 includes a document sheet tray 59*a* to hold a bundle of original documents thereon. The ADF 59 separates each original document one by one from the bundle of original documents placed on the document sheet tray 59*a* to automatically feed the separated original document onto an exposure glass mounted on the document reader 58.

The document reader 58 reads image data of the original document fed from the ADF 59 on the exposure glass.

The image forming device 50 forms an image on a sheet functioning as a recording medium fed by the sheet feeding device 52 according to the image data of the original document read in the document reader 58.

The sheet feeding device 52 is disposed below the image forming device 50. The sheet feeding device 52 accommodates a bundle of sheets 1 or recording media therein to feed an uppermost sheet 1*a* that is placed on top of the bundle of sheets 1 to be picked up from the bundle of sheets 1, to the image forming device 50.

The image forming device 50 includes a photoconductor 61 that functions as a latent image bearer, and image forming components disposed around the photoconductor 61. The image forming components are, for example, a photoconductor charger 62, a developing device 64, a transfer device 54, and a photoconductor cleaning device 65. The image forming device 50 further includes an optical writing device to emit a laser light beam 63 to the photoconductor 61 and a fixing device 55 to fix a toner image to a sheet that functions as a recording medium.

The image forming device 50 performs the following image forming operations. As the photoconductor 61 rotates, the photoconductor charger 62 uniformly charges a surface of the photoconductor 61. The optical writing device emits the laser light beam 63 to the surface of the photoconductor 61.

By so doing, the surface of the photoconductor 61 is irradiated by the laser light beam 63 based on image data inputted from a personal computer or a word processor or image data of an original document read by the document reader 58, so that an electrostatic latent image is formed on the surface of the photoconductor 61. Thereafter, the developing device 64 supplies toner to the electrostatic latent image to develop the electrostatic latent image into a toner image formed on the surface of the photoconductor 61.

The sheet feeding device 52 separates sheets one by one and conveys a sheet toward a pair of registration rollers 53. The sheet abuts against the pair of registration rollers 53 to stop. In synchronization with timing of image formation in the image forming device 50, the sheet contacted and stopped at the pair of registration rollers 53 is conveyed to a transfer area where the photoconductor 61 and the transfer device 54 are disposed facing each other. The toner image formed on the surface of the photoconductor 61 is transferred onto the sheet in the transfer area. The fixing device 55 fixes the toner image transferred onto the sheet to the sheet, and the sheet with the fixed toner image is conveyed by a pair of sheet discharging rollers 56 to a sheet discharging tray 57. After transfer of the toner image onto the sheet, the photoconductor cleaning device 65 cleans the surface of the photoconductor 61 by removing residual toner remaining on the surface of the photoconductor 61 to be ready for a subsequent image forming operation.

Figure 2:
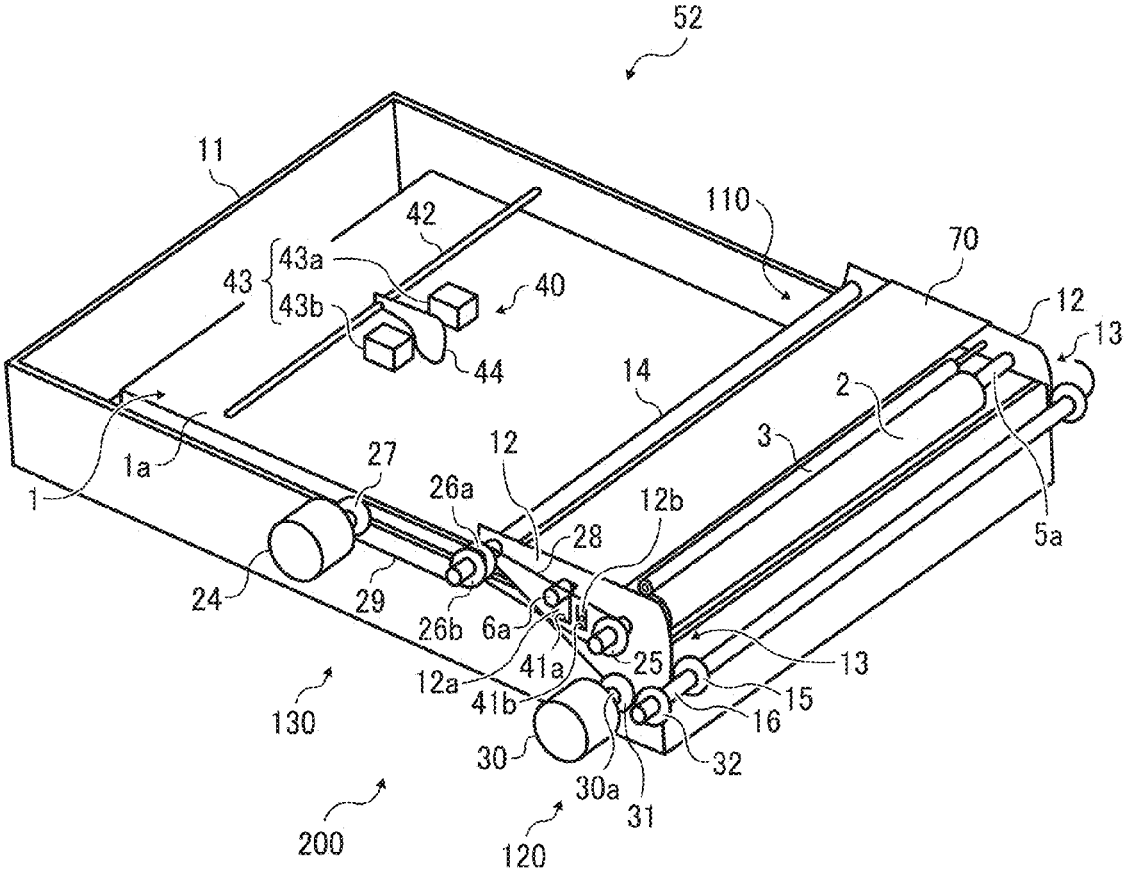
FIG. 2 is a perspective view illustrating a schematic configuration of a sheet feeding device including a sheet feeder according to an example of this disclosure.
Figure 3:
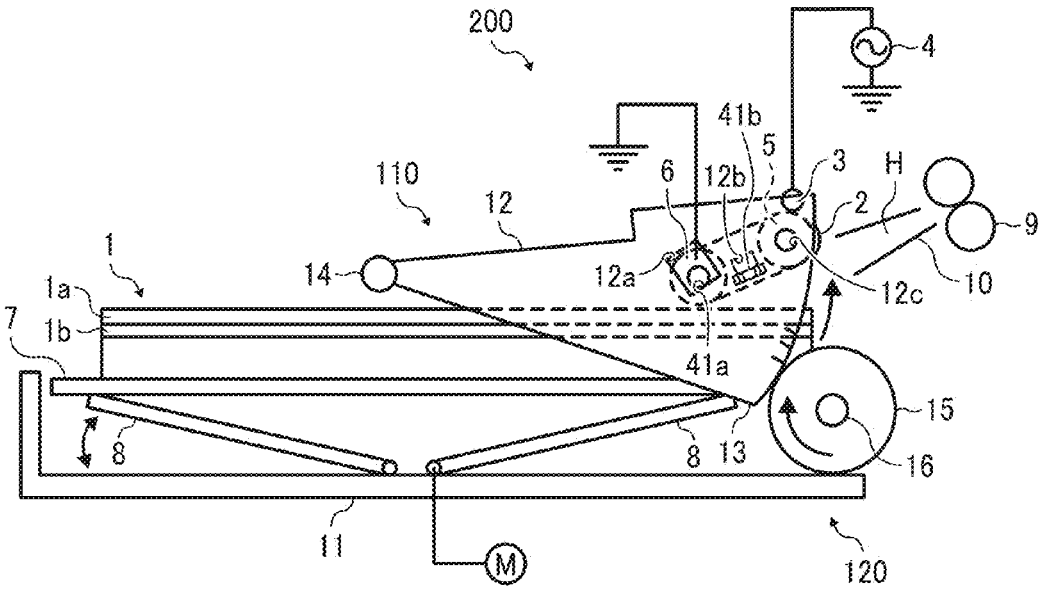
FIG. 3 is a perspective view illustrating the configuration of the sheet feeding device including the sheet feeder.

FIG. 2 is a perspective view illustrating a schematic configuration of the sheet feeding device 52 including a sheet feeder 200. FIG. 3 is a side view illustrating the sheet feeding device 52 including the sheet feeder 200.

The sheet feeding device 52 includes a sheet tray 11 and the sheet feeder 200. The sheet tray 11 functions as a sheet container to accommodate the bundle of sheets 1 of multiple sheets. The sheet feeder 200 separates and conveys the uppermost sheet 1*a* placed on top of the bundle of sheets 1 on the sheet tray 11. In addition, the sheet feeding device 52 includes a pair of sheet conveying rollers 9.

As illustrated in FIG. 3, the sheet tray 11 includes a bottom plate 7 on which the bundle of sheets 1 is loaded. Plate supporting members 8 are rotatably provided between a bottom surface of the sheet tray 11 and the bottom plate 7 to support the bottom plate 7. Further, as illustrated in FIG. 2, the sheet feeding device 52 includes a sheet detector 40 to detect that the uppermost sheet 1*a* of the bundle of sheets 1 has reached a predetermined position.

The sheet detector 40 includes a shaft 42, a thru-beam optical sensor 43, and a feeler 44. The feeler 44 is rotatably supported by the shaft 42 attached to an apparatus body 101. The thru-beam optical sensor 43 includes a light receiving element 43*a* and a light emitting element 43*b*.

As a drive motor M drives the plate supporting members 8 to lift the bottom plate 7, the bundle of sheets 1 loaded on the bottom plate 7 is elevated so that the uppermost sheet 1*a* contacts the feeler 44. At this time, the light receiving element 43*a* of the thru-beam optical sensor 43 receive light emitted by the light emitting element 43*b*. As the bottom plate 7 is further lifted, the feeler 44 blocks the light from the light emitting element 43*b*, by which the light receiving element 43*a* is prevented from receive light. Consequently, the sheet detector 40 detects that the uppermost sheet 1*a* of the bundle of sheets 1 has reached the predetermined position, and movement of the plate supporting members 8 is stopped.

The sheet feeder 200 includes a sheet attraction and separation unit 110, a swing unit 120, and a belt driving unit 130.

The sheet attraction and separation unit 110 includes a sheet attraction belt 2 that functions as a charged target body.

The swing unit 120 that functions as a movable unit to swing the sheet attraction and separation unit 110.

The belt driving unit 130 rotates the sheet attraction belt 2 as an endless loop.

Figure 4A:
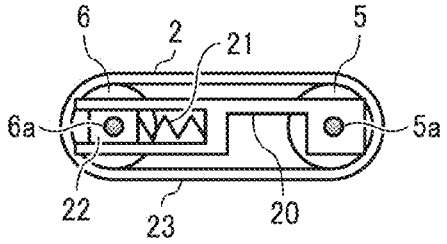
FIG. 4A is a side view illustrating a partial configuration of a sheet attraction and separation unit included in the sheet feeder.
Figure 4B:
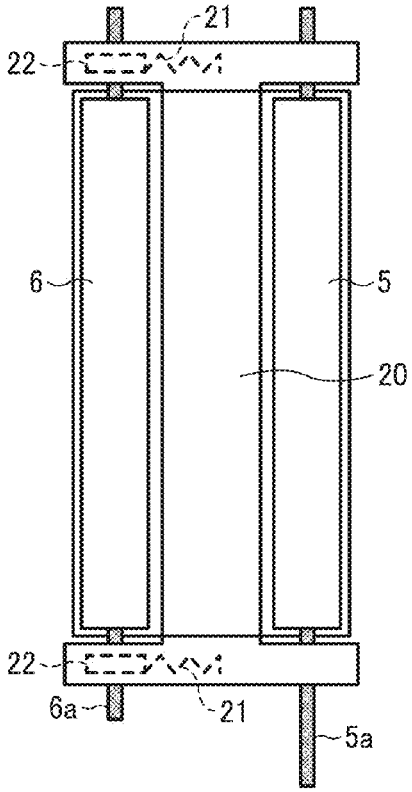
FIG. 4B is a top view illustrating the configuration of the sheet attraction and separation unit of FIG. 4A.

FIG. 4A is a side view illustrating a partial configuration of the sheet attraction and separation unit 110 included in the sheet feeder 200. FIG. 4B is a top view illustrating the configuration of the sheet attraction and separation unit 110 of FIG. 4A.

As illustrated in FIGS. 4A and 4B, the sheet attraction belt 2 is stretched about a downstream side tension roller 5 and an upstream side tension roller 6.

The sheet attraction belt 2 has a multilayer construction that includes a front surface layer 2*a* and a back surface layer 2*b*. The front surface layer 2*a* of the sheet attraction belt 2 is an insulating polyethylene terephthalate film having a thickness of about 50 μm and has a resistivity of $10^8$ Ω·cm minimum. The back surface layer 2*b* of the sheet attraction belt 2 is a conductive layer made of aluminum-deposited dielectric material having a resistivity of $10^6$ Ω·cm maximum.

With the above-described multilayer construction of the sheet attraction belt 2, the back surface layer 2*b* (the conductive layer) of the sheet attraction belt 2 can be used as a grounded opposite electrode, and a belt charger 3 and a power supply 4 to apply electric charge to the sheet attraction belt 2 can be disposed at any position that contacts the front surface layer 2*a* of the sheet attraction belt 2. It is to be noted that a combination of the belt charger 3 and the power supply 4 functions as a charger.

Further, ribs 23 are provided within both edges in a belt direction of the sheet attraction belt 2 for preventing meandering of the sheet attraction belt 2. The ribs 23 are engaged with the downstream side tension roller 5 and the upstream side tension roller 6 to prevent meandering of the sheet attraction belt 2.

The downstream side tension roller 5 has a conductive rubber layer as a front surface layer having a resistivity of about 106 Ω·cm. The upstream side tension roller 6 is a metallic roller. The downstream side tension roller 5 and the upstream side tension roller 6 are electrically grounded.

The downstream side tension roller 5 has a small diameter suitable for separating the sheet from the sheet attraction belt 2 due to the curvature. That is, the diameter of the downstream side tension roller 5 is formed relatively small to make the curvature relatively large, and thus the sheet attracted and conveyed by the sheet attraction belt 2 can be separated from the downstream side tension roller 5 and conveyed into a sheet conveying path H defined by a guide 10 disposed downstream from the downstream side tension roller 5 in a sheet conveying direction.

As illustrated in FIGS. 4A and 4B, the downstream side tension roller 5 has a shaft 5*a* and the upstream side tension roller 6 has a shaft 6*a*. The shaft 5*a* of the downstream side tension roller 5 is rotatably supported by a housing 20. The shaft 6*a* of the upstream side tension roller 6 is rotatably supported by a bearing 22 that is slidably held in the sheet conveying direction with respect to the housing 20. The bearing 22 is biased by a spring 21 toward an upstream side in the sheet conveying direction. Consequently, the upstream side tension roller 6 is biased toward the upstream side in the sheet conveying direction to apply tension to the sheet attraction belt 2.

As illustrated in FIGS. 2 and 3, the sheet attraction and separation unit 110 includes brackets 12 at both ends in a belt width direction of the sheet attraction belt 2 to rotatably hold the sheet attraction belt 2. Each bracket 12 is rotatably supported by a supporting shaft 14 that is disposed upstream from the upstream side tension roller 6 in the sheet conveying direction. With this configuration, the sheet attraction and separation unit 110 is driven by the swing unit 120, details of which are described below, to pivot on the supporting shaft 14 between a sheet contact position and a sheet separation position.

It is to be noted that the sheet contact position is a position at which the sheet attraction belt 2 contacts and attracts the uppermost sheet 1*a* of the bundle of sheets 1. The sheet separation position is a position away from the sheet contact position and where the uppermost sheet 1*a* attracted to the sheet attraction belt 2 separates from the bundle of sheets 1 to be conveyed for a subsequent image forming operation.

A long slot 12*a* is formed on each bracket 12. The shaft 6*a* of the upstream side tension roller 6 is inserted into the long slot 12*a*, by which the shaft 6*a* is rotatably supported by the brackets 12 to move along the long slot 12*a*. Consequently, the upstream side tension roller 6 is movably held with respect to the brackets 12.

By contrast, the shaft 5*a* of the downstream side tension roller 5 is inserted into a different slot 12*c* formed on each bracket 12, by which the shaft 5*a* is fixedly held by the brackets 12.

As illustrated in FIG. 4, when the sheet attraction and separation unit 110 is at the sheet separation position, the shaft 6*a* of the upstream side tension roller 6 remains in contact with a lower end face 41*a* of the slot 12*a*.

To prevent variation of the distance between a center of rotation of the upstream side tension roller 6 and a center of rotation of the downstream side tension roller 5, the respective slots 12*a* on the brackets 12 are formed in a shape of an arc, the center of which corresponds to the center of rotation of the downstream side tension roller 5. As a result, even if the upstream side tension roller 6 moves along the slots 12*a*, the distance between the center of rotation of the upstream side tension roller 6 and the center of rotation of the downstream side tension roller 5 can remain the same and the tension of the sheet attraction belt 2 can also remain.

Generally, when the sheet attraction belt 2 has a tension of 5N or smaller, the sheet attraction belt 2 rotates without slipping on the downstream tension roller 5 and the upstream side tension roller 6, so that the uppermost sheet 1*a* attracted to the sheet attraction belt 2 can be conveyed.

By contrast, when conveying special sheets such as sheets having a high adhesion, it is likely that the sheet attraction belt 2 slips on the downstream side tension roller 5 and the upstream side tension roller 6.

In order to address this inconvenience, it is preferable to increase coefficients of friction on the surface of the upstream side tension roller 6 and the surface of the downstream side tension roller 5 to prevent slippage of the sheet attraction belt 2 with respect to the downstream side tension roller 5 and the upstream side tension roller 6.

Figure 5A:
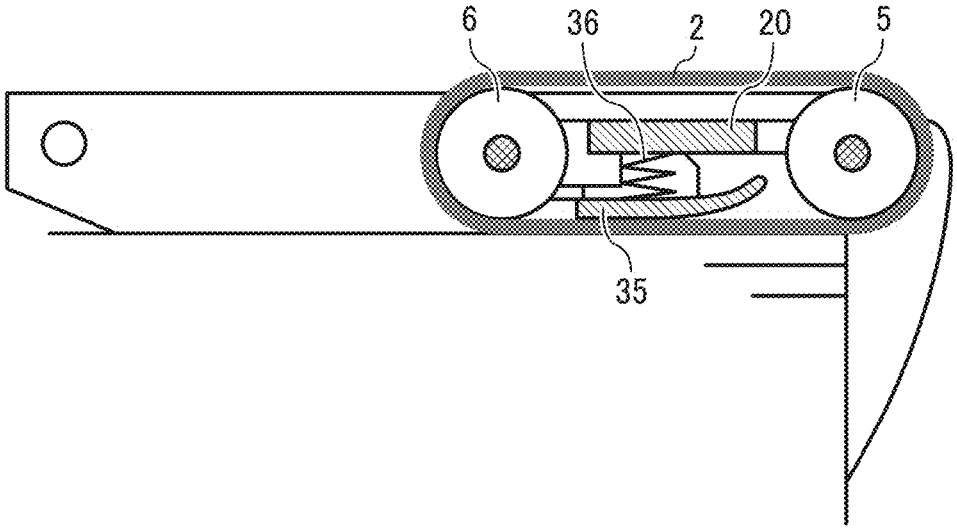
FIG. 5A is a side view illustrating a pressing unit provided to the sheet attraction and separation unit.
Figure 5B:
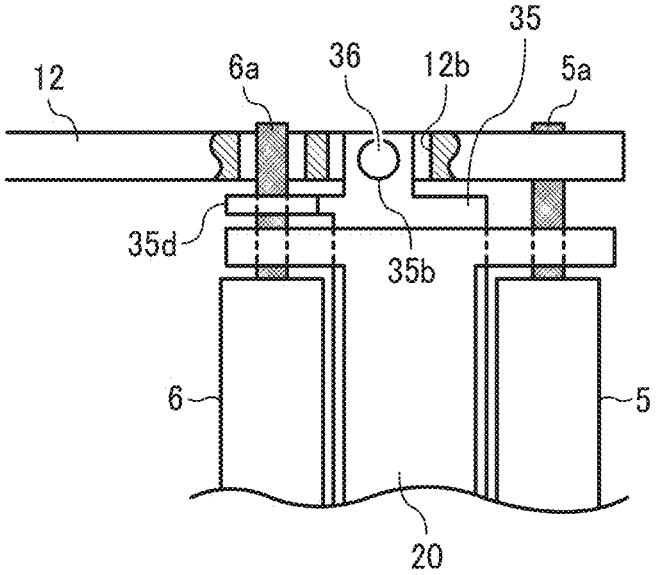
FIG. 5B is a top view illustrating the pressing unit provided to the sheet attraction and separation unit of FIG. 5A.

FIG. 5A is a side view illustrating a pressing unit 35 provided to the sheet attraction and separation unit 110. FIG. 5B is a top view illustrating the pressing unit provided to the sheet attraction and separation unit 110 of FIG. 5A. As illustrated in FIGS. 5A and 5B, the sheet attraction and separation unit 110 includes the pressing unit 35 inside the endless loop of the sheet attraction belt 2 to press the sheet attraction belt 2 toward the bundle of sheets 1.

The pressing unit 35 is a planar member and includes holder portions 35*b* and shaft supporting portions 35*d* at both ends in an axial direction of the pressing unit 35, as illustrated in FIG. 5B. The holder portions 35*b* are held by long slots 12*b* of the brackets 12.

The long slots 12*b* include respective lower end faces 41*b* and respective compression springs 36. Each of the compression springs 36 functions as an elastic member to bias each of the holder portions 35*b* toward the bundle of sheets 1.

The shaft supporting portions 35*d* have respective holes. The shaft 6*a* of the upstream side tension roller 6 is inserted into the holes of the shaft supporting portions 35*d*. By so doing, the pressing unit 35 is rotatably supported by the shaft 6*a* of the upstream side tension roller 6.

The pressing unit 35 has a leading edge that is curved by a predetermined radius of curvature.

Figure 6:
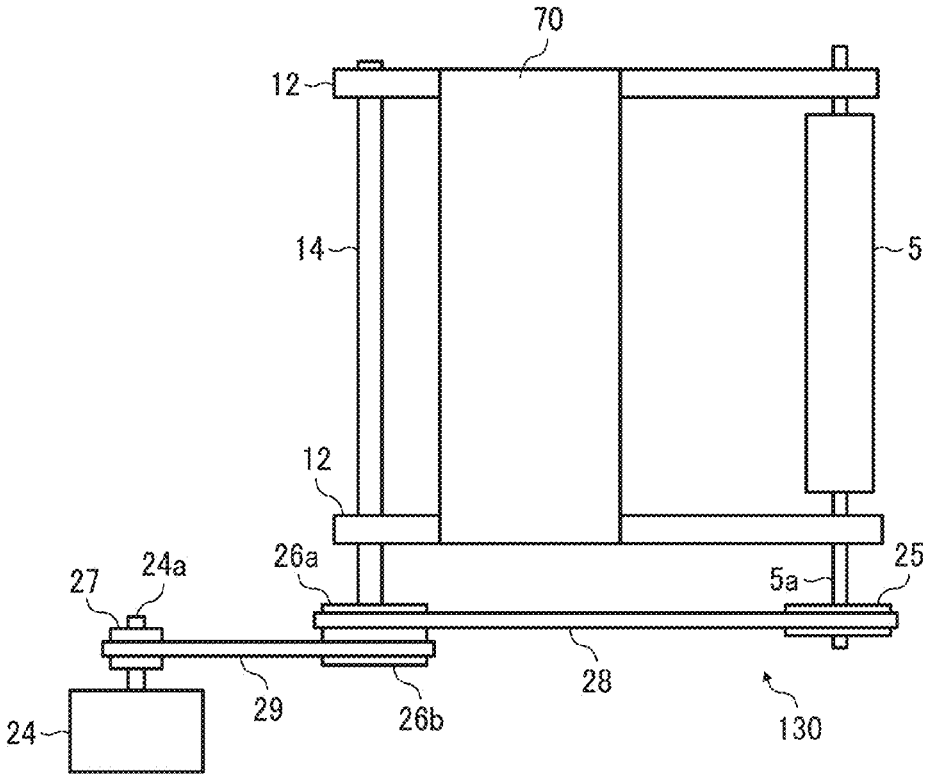
FIG. 6 is a diagram illustrating a schematic configuration of a belt driving unit that drives to rotate a sheet attraction belt.

FIG. 6 is a diagram of a schematic configuration of the belt driving unit 130 that rotates the sheet attraction belt 2.

As illustrated in FIG. 6, a first driven pulley 26*a* and a second drive pulley 26*b* are attached to one end of the supporting shaft 14 that rotatably supports each bracket 12.

As illustrated in FIG. 6, a first driven pulley 26*a* and a second driving pulley 26*b* are attached to one end of the supporting shaft 14 that rotatably supports each bracket 12. A second driven pulley 25 is attached to one end of the downstream side tension roller 5. A driven timing belt 28 is wound around the first driven pulley 26*a* and the second driven pulley 25. A driving motor 24 is disposed upstream from the supporting shaft 14 in the sheet conveying direction. A first driving pulley 27 is attached to a motor shaft 24*a* of the driving motor 24. A driving timing belt 29 is wound around the first driving pulley 27 and the second driving pulley 26*b*.

As the driving motor 24 drives, the downstream side tension roller 5 rotates via the driving timing belt 29 and the driven timing belt 28. The rotation of the downstream side tension roller 5 rotates via the sheet attraction belt 2, by which the upstream side tension roller 6 is rotated due to friction along with an inner circumferential surface of the sheet attraction belt 2.

Further, in the present example of this disclosure, a driving force generated by the driving motor 24 is transmitted to the downstream side tension roller 5 via the supporting shaft 14 that supports the brackets 12. With this configuration, the sheet attraction and separation unit 110 pivots on the supporting shaft 14. Therefore, even if the sheet attraction and separation unit 110 swings, the distance between the downstream side tension roller 5 and the supporting shaft 14 remains unchanged. Accordingly, the tension of the driven timing belt 28 can be maintained and the driving force of the driving motor 24 can be well transmitted to the downstream side tension roller 5.

It is to be noted that the configuration of the belt driving unit 130 is not limited thereto but can transmit the driving force from the driving motor 24 to the upstream side tension roller 6 and employ the upstream side tension roller 6 as a driving roller that rotates the sheet attraction belt 2.

Further, as illustrated in FIGS. 2 and 3, the swing unit 120 that functions as a movable unit to swing the brackets 12 is disposed downstream from the sheet feeding device 52 in the sheet conveying direction. The swing unit 120 includes a rack gear 13 and a pinion gear 15. The rack gear 13 functions as a first drive transmitter disposed at one downstream end of each bracket 12 in the sheet conveying direction. The pinion gear 15 functions as a second drive transmitter that is fixed to a rotary shaft 16 and meshes with the rack gear 13. The swing unit 120 further includes a swing motor 30. A driven gear 32 is disposed at one end of the rotary shaft 16. The driven gear 32 meshes with a motor gear 31 that is attached to a motor shaft 30*a* of the swing motor 30.

The pinion gears 15 provided corresponding to the respective brackets 12 are attached to the rotary shaft 16 that rotates coaxially with the pinion gear 15. With this configuration, rotation of the rotary shaft 16 by the swing motor 30 rotates the pinion gear 15. By so doing, a single unit of the swing motor 30 can rotate these two pinion gears 15 disposed at both ends in the belt width direction of the sheet attraction belt 2. Therefore, the number of components of the image forming apparatus 100 can be decreased, which can reduce the cost of the image forming apparatus 100. In addition, driving of the rack and pinion mechanism disposed at both ends in the belt width direction of the sheet attraction belt 2 can be synchronized with a simple configuration as described above.

The rack gear 13 is an R-shaped gear rotating about the supporting shaft 14. The rack gears 13 arranged on the respective brackets 12 pivot on the supporting shaft 14 when the sheet attraction and separation unit 110 swings. Therefore, the R-shaped rack gears 13 that rotate about the supporting shaft 14 can keep the rack gear 13 and the pinion gear 15 meshed when the sheet attraction and separation unit 110 swings.

Further, by arranging the rack gear 13 at the downstream end of the bracket 12 in the sheet conveying direction, the number of components can be decreased and a simpler configuration can be achieved when compared with a configuration in which a rack gear separated from the bracket 12 is attached to the bracket 12.

Further, since the pinion gears of the rack and pinion mechanism of the swing unit 120 are provided to the apparatus body 101 of the image forming apparatus 100, a simpler configuration for transmitting a driving force to the pinion gears 15 can be achieved when compared with a configuration in which the pinion gears 15 are provided to the sheet attraction and separation unit 110.

By driving the swing motor 30 in the swing unit 120 having this configuration, the pinion gear 15 rotates to cause the rack gear 13 to move in a direction to separate from the bundle of sheets 1. Accordingly, each of the brackets 12 pivots on the supporting shaft 14.

The brackets 12 are fixed and connected to each other by a reinforcement member 70. By fixing the brackets 12 via the reinforcement member 70, one bracket 12 can swing together with the other bracket 12 integrally. This configuration can restrict twist of the sheet attraction belt 2 held by the brackets 12 when swinging the brackets 12 and can prevent the uppermost sheet 1*a* attracted to the sheet attraction belt 2 from separating from the sheet attraction belt 2.

Figure 7:
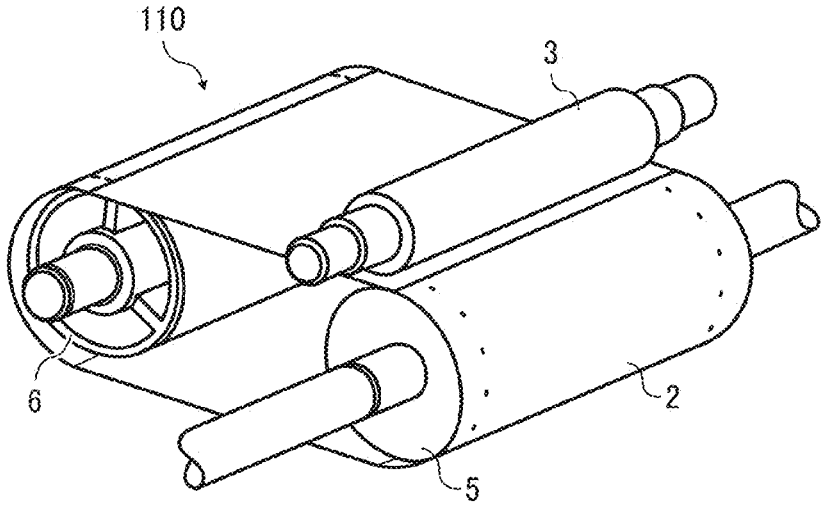
FIG. 7 is a perspective view illustrating a partial configuration of the sheet attraction and separation unit.

FIG. 7 is a perspective view illustrating a partial configuration of the sheet attraction and separation unit 110.

As illustrated in FIG. 7, the roller-shaped belt charger 3 that functions as a charger to uniformly charge the surface of the sheet attraction belt 2 contacts the surface of the sheet attraction belt 2. The belt charger 3 is rotatably attached to the sheet attraction and separation unit 110. A position of the belt charger 3 is determined uniquely with respect the sheet attraction belt 2.

Further, the belt charger 3 is connected to the power supply 4 that generates alternating current.

It is to be noted that, alternative to the roller-shaped belt charger 3 used in the present example, a blade-shaped belt charger can be used. Since the roller-shaped belt charger 3 can be rotated with the sheet attraction belt 2, and therefore can reduce abrasion or wear of the sheet attraction belt 2 when compared with the blade-shaped belt charger.

Next, a description is given of basic sheet conveying operations performed by the sheet feeder 200 according to the present example of this disclosure, with reference to FIGS. 8A through 8E and 9A through 9C.

Figure 8A:
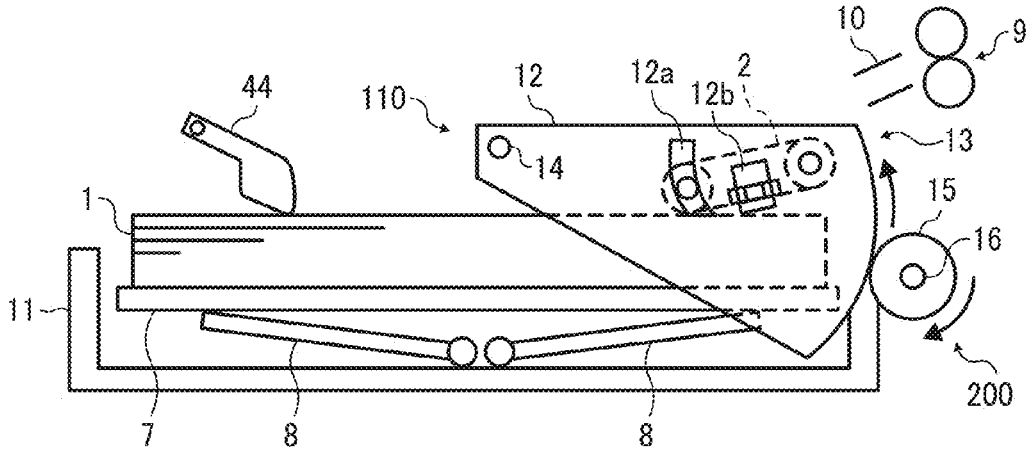
FIG. 8A is a diagram illustrating a sheet feeding operation performed by the sheet feeder in the sheet feeding device.
Figure 8B:
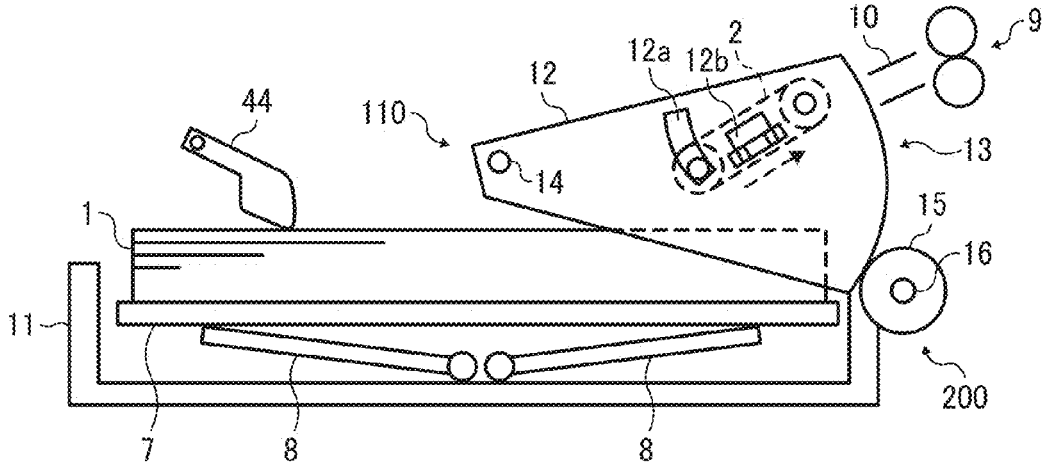
FIG. 8B is a diagram illustrating a subsequent sheet feeding operation after FIG. 8A.
Figure 8C:
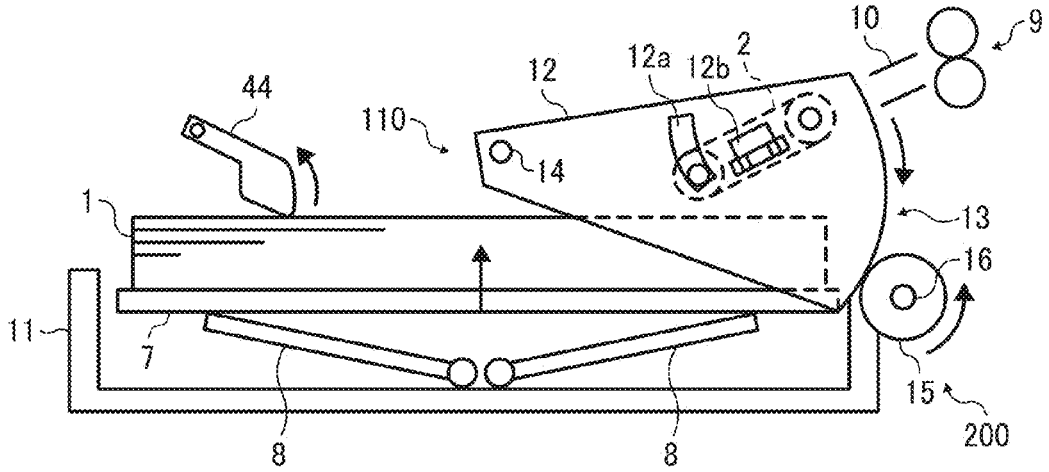
FIG. 8C is a diagram illustrating another subsequent sheet feeding operation after FIG. 8B.
Figure 8D:
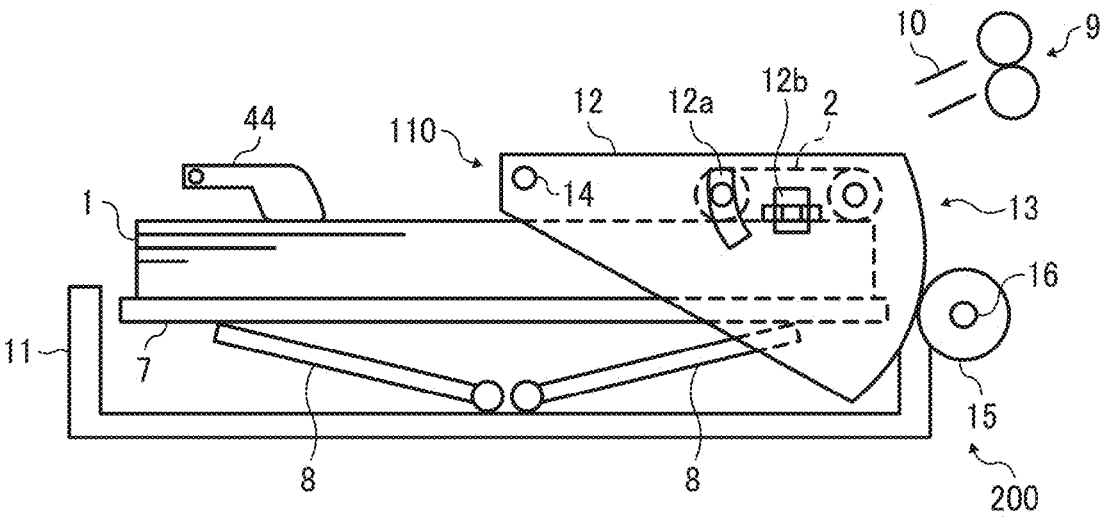
FIG. 8D is a diagram illustrating yet another subsequent sheet feeding operation after FIG. 8C.
Figure 9A:
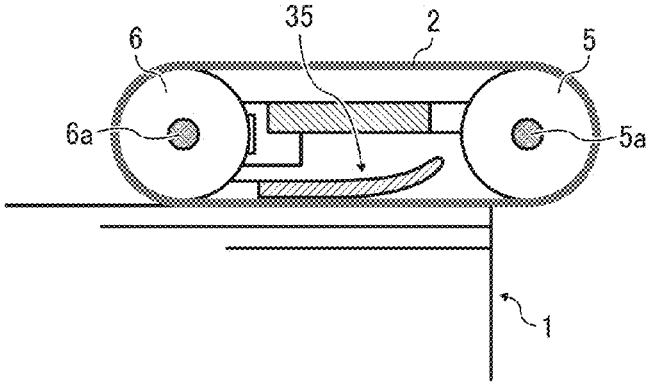
FIG. 9A is a diagram illustrating movement of the pressing unit in the sheet feeding operation.
Figure 9B:
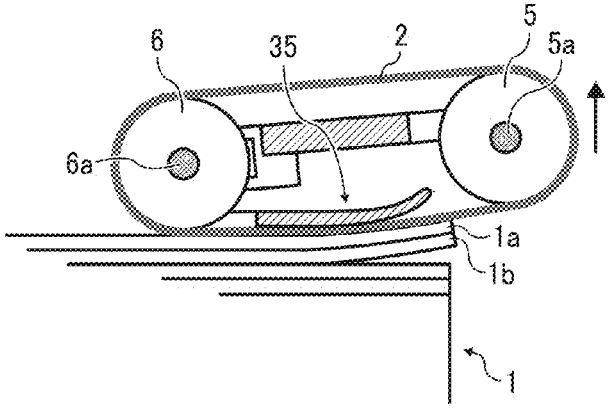
FIG. 9B is a diagram illustrating subsequent movement of the pressing unit in the sheet feeding operation after FIG. 9A.
Figure 9C:
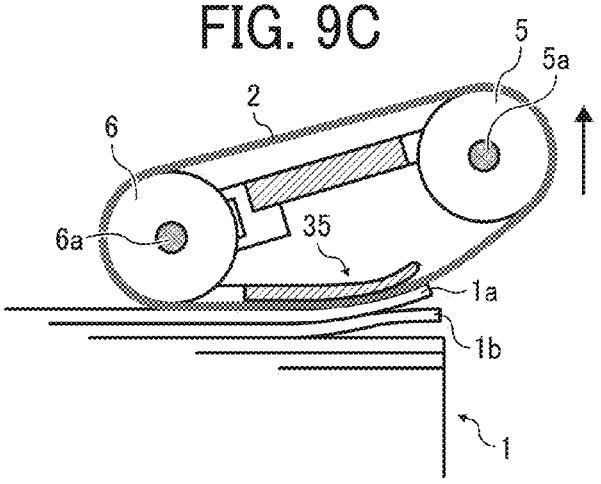
FIG. 9C is a diagram illustrating another subsequent movement of the pressing unit in the sheet feeding operation after FIG. 9B.

FIG. 8A is a diagram illustrating a sheet feeding operation performed by the sheet feeder 200 in the sheet feeding device 52. FIG. 8B is a diagram illustrating a subsequent sheet feeding operation after FIG. 8A. FIG. 8C is a diagram illustrating another subsequent sheet feeding operation after FIG. 8B. FIG. 8D is a diagram illustrating yet another subsequent sheet feeding operation after FIG. 8C. Ha 8E is a diagram illustrating yet another subsequent sheet feeding operation after FIG. 8D. FIG. 9A is a diagram illustrating movement of the pressing unit 35 in the sheet feeding operation. FIG. 9B is a diagram illustrating subsequent movement of the pressing unit 35 in the sheet feeding operation after FIG. 9A. FIG. 9C is a diagram illustrating another subsequent movement of the pressing unit 35 in the sheet feeding operation after FIG. 9B.

As illustrated in FIG. 8A, the bottom plate 7 is located at a lower position and the sheet attraction and separation unit 110 stands by at the sheet contact position. Upon receipt of a sheet feeding signal, the swing motor 30 (see FIG. 2) is driven to rotate the pinion gear 15 in a clockwise direction in FIG. 8A. Then, the sheet attraction and separation unit 110 pivots on the supporting shaft 14 in a counterclockwise direction in FIG. 8A, or in the direction to separate from the bundle of sheets 1. When the sheet attraction and separation unit 110 reaches the sheet separation position, the driving of the swing motor 30 is stopped.

As illustrated in FIG. 8B, at the stop of the sheet attraction and separation unit 110 at the sheet separation position, the driving motor 24 is driven to move the sheet attraction belt 2 endlessly. Then, the power supply 4 applies an alternating voltage to the sheet attraction belt 2 via the belt charger 3 to form charge patterns on an outer circumferential surface of the sheet attraction belt 2. The charge patterns alternate with a pitch according to the frequency of the alternating current power supply and the rotation speed of the sheet attraction belt 2. Preferably, the pitch is set between 5 mm and 15 mm. As well as the alternating current voltage, the power supply 4 may also provide a direct current voltage alternated between high and low potentials, for example, square wave and sine wave. In the present example, the power supply 4 applies a sine wave voltage having an amplitude of approximately 4 kV (kilovolts) to the outer circumferential surface of the sheet attraction belt 2.

After completion of charging the sheet attraction belt 2, the sheet attraction belt 2 is stopped the rotation and the bottom plate 7 that stands by at a lower position in the sheet tray 11 is started to elevate, as illustrated in FIG. 8C. Substantially simultaneously, the swing motor 30 is reversely driven to rotate the pinion gear 15 in the counterclockwise direction in FIG. 8C. With this action, the sheet attraction and separation unit 110 pivots on the supporting shaft 14 in the clockwise direction or in a direction to approach the bundle of sheets 1 in FIG. 8C.

As the bottom plate 7 ascends and the sheet attraction and separation unit 110 descends, the uppermost sheet 1*a* of the bundle of sheets 1 contacts the upstream side tension roller 6 via the sheet attraction belt 2. As the bottom plate 7 further ascends and the sheet attraction and separation unit 110 further descends, the upstream side tension roller 6 is pushed up by the bundle of sheets 1. Consequently, the upstream side tension roller 6 remaining in contact with the lower end face 41*a* of the long slot 12*a* moves upwardly along the long slot 12*a*. Further, along with elevation of the bottom plate 7, the feeler 44 rotates in the counterclockwise direction in FIG. 8C. When the uppermost sheet 1*a* of the bundle of sheets 1 reaches the predetermined position, the feeler 44 blocks the light emitted by the light emitting element 43*b* of the thru-beam optical sensor 43. With this action, the thru-beam optical sensor 43 detects that the uppermost sheet 1*a* of the bundle of sheets 1 has reached the predetermined position, and elevation of the bottom plate 7 stops.

Further, when the sheet attraction and separation unit 110 reaches the sheet contact position, the swing motor 30 stops rotating.

In a case in which the swing motor 30 is a stepping motor, the swing motor 30 is controlled based on the angle of rotation (the number of pulses). By so doing, the sheet attraction and separation unit 110 can stop at the sheet contact position with accuracy.

By contrast, in a case in which the swing motor 30 is a DC motor, the swing motor 30 is controlled based on the driving period, so that the sheet attraction and separation unit 110 can stop at the sheet contact position with accuracy.

As illustrated in FIG. 8D, the bottom plate 7 stops elevating, the sheet attraction and separation unit 110 then stops descending (swinging). In this state, a portion of the sheet attraction belt 2 facing the upper surface of the bundle of sheets 1 contacts the uppermost sheet 1*a* contacts the uppermost sheet 1*a* of the bundle of sheets 1. Further, as illustrated in FIG. 9A, the sheet attraction belt 2 is pressed against the uppermost sheet 1*a* by the pressing unit 35 at the sheet contact position. At this time, the shaft 6*a* of the upstream side tension roller 6 and the holder portions 35*b* of the pressing unit 35 are separated from the lower end faces 41*a* of the long slots 12*a* and the lower end faces 41*b* of the long slots 12*b* provided to the brackets 12.

As the sheet attraction belt 2 thus comes into contact with the uppermost sheet 1*a*, Maxwell stress acts on the uppermost sheet 1*a*, which is a dielectric material, due to the electrical field generated by the charge patterns formed on the outer circumferential surface of the sheet attraction belt 2. As a result, the uppermost sheet 1*a* of the bundle of sheets 1 is attracted to the sheet attraction belt 2.

After the sheet attraction and separation unit 110 stands by for a predetermined time in the state illustrated in FIG. 8D and the uppermost sheet 1*a* is attracted to the sheet attraction belt 2, the swing motor 30 is driven to rotate the pinion gear 15 in the clockwise direction so as to rotate the sheet attraction and separation unit 110 on the supporting shaft 14 in the counterclockwise direction in FIG. 8D. Then, the downstream side tension roller 5 moves together with the brackets 12 in the direction to separate from the bundle of sheets 1.

By contrast, the shaft 6*a* of the upstream side tension roller 6 and the holder portions 35*b* of the pressing unit 35 move downward along inner surfaces of the respective long slots 12*a* and 12*b*. According to the movement, the sheet attraction belt 2 is pressed by the pressing unit 35 toward the bundle of sheets 1, and therefore an upstream portion from the pressing portion of the sheet attraction belt 2 pressed by the pressing unit 35 remains in contact with the upper surface of the bundle of sheets 1.

By contrast, a downstream portion from the pressing portion of the sheet attraction belt 2 pressed by the pressing unit 35 is lifted and separated from the upper surface of the bundle of sheets 1. With this action, while the upstream portion from the pressing portion of the uppermost sheet 1*a* that is attracted to the sheet attraction belt 2 is pressed by the sheet attraction belt 2, the downstream portion from the pressing portion of the uppermost sheet 1*a* (i.e., the leading edge of the uppermost sheet 1*a*) is lifted by the attraction force of the sheet attraction belt 2.

As the sheet attraction and separation unit 110 is further rotated to the sheet separation position, the shaft 6*a* of the upstream side tension roller 6 comes into contact with the lower end faces 12*a* of the long slots 12*a* and the holder portions 35*b* of the pressing unit 35 comes into contact with the lower end faces 12*b* of the long slots 12*b*. At this time, the sheet attraction belt 2 contacts a leading edge of the pressing unit 35, and therefore bends along with the curvature of the leading edge of the pressing unit 35. Accordingly, the uppermost sheet 1*a* attracted to the sheet attraction belt 2 also bends along with the curvature of the leading edge of the pressing unit 35. The curvature of the leading edge of the pressing unit 35 is set so as not to separate the uppermost sheet 1*a* from the sheet attraction belt 2. Accordingly, as illustrated in FIG. 9C, while the uppermost sheet 1*a* remains attracted to the sheet attraction belt 2 without separating the sheet attraction belt 2, a subsequent sheet 1*b* is separated from the uppermost sheet 1*a*.

Further, as the sheet attraction and separation unit 110 is further rotated to the sheet separation position to rise, the pressing unit 35 moves upward together with the sheet attraction and separation unit 110 against the biasing force applied by the compression springs 36. Along with the movement of the pressing unit 35, the shaft 6*a* of the upstream side tension roller 6 moves downward along the inner surface of the long slots 12*a*. Accordingly, the degree of the curve of the sheet attraction belt 2 formed according to the curvature of the leading edge of the pressing unit 35 becomes smaller to be eliminated. Consequently, when the shaft 6*a* of the upstream side tension roller 6 contacts the lower end face 41*a* of the long slot 12*a*, the pressing unit 35 is separated from the sheet attraction belt 2, and therefore the curve of the sheet attraction belt 2 facing the bundle of sheets 1 is eliminated.

When the sheet attraction and separation unit 110 is further rotated in a state in which the upstream side tension roller 6 remains in contact with the lower end face 41*a* of the long slot 12*a*, the upstream side tension roller 6 moves together with the brackets 12 to separate from the upper surface of the bundle of sheets 1.

Figure 8E:
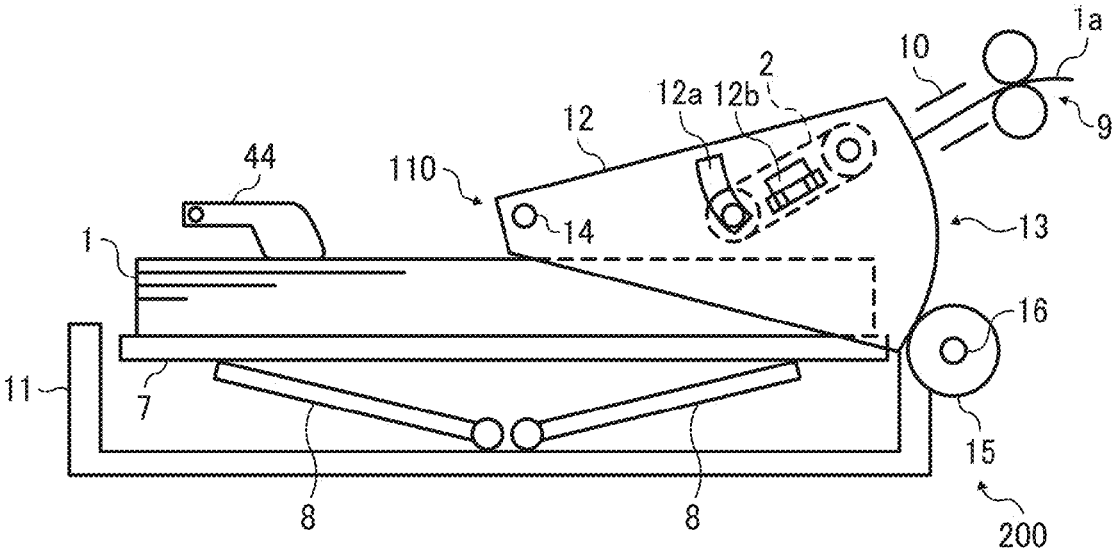
FIG. 8E is a diagram illustrating yet another subsequent sheet feeding operation after FIG. 8D.

Then, as illustrated in FIG. 8E, when the sheet attraction and separation unit 110 reaches the sheet separation position to convey the uppermost sheet 1*a* further, the driving of the swing motor 30 is stopped. After the swing motor 30 is stopped, the driving motor 24 is turned on to move the sheet attraction belt 2 endlessly, so as to convey the uppermost sheet 1*a* attracted to the sheet attraction belt 2 toward the pair of sheet conveying rollers 9. As the leading edge of the uppermost sheet 1*a* electrostatically attracted to the sheet attraction belt 2 reaches a corner where the inner circumferential surface of the sheet attraction belt 2 contacting the downstream side tension roller 5, the uppermost sheet 1*a* separates from the sheet attraction belt 2 due to curvature separation, and moves toward the pair of sheet conveying rollers 9 while being guided by the guide 10.

The pair of sheet conveying rollers 9 and the sheet attraction belt 2 are controlled to have the same linear velocity. Therefore, when the pair of sheet conveying rollers 9 is intermittently driven to adjust the timing, the driving motor 24 is also controlled to drive the sheet attraction belt 2 intermittently. Further, it is also acceptable that the belt driving unit 130 can include an electromagnetic clutch to control the driving of the sheet attraction belt 2.

An adhesion by the charge patterns affects to the uppermost sheet 1*a* and does not affect the subsequent sheet 1*b* and any other subsequent sheets after the subsequent sheet 1*b*. In the present example, a friction force applied between the pickup device and the sheet are not used. Therefore, a contact pressure between the sheet attraction belt 2 and the bundle of sheets 1 can be substantially small. Accordingly, the configuration of the sheet feeder 200 does not cause a multi-feed error in which multiple sheets are fed at one time.

The sheet attraction belt 2 is controlled such that the uppermost sheet 1*a* is separated from the bundle of sheets 1 and the subsequent sheet 1*b* is not attracted to the sheet attraction belt 2 before the trailing edge of the uppermost sheet 1*a* reaches an opposing position facing the upstream side tension roller 6.

Next, a description is given of the detailed configuration of the sheet feeder 200 according to the present example of this disclosure.

In the present example, proximity electrical discharge is generated in a fine clearance between the belt charger 3 and the outer circumferential surface of the sheet attraction belt 2. The proximity electrical discharge forms the charge patterns to alternate on the outer circumferential surface of the sheet attraction belt 2. The proximity electrical discharge generated in the fine clearance between the belt charger 3 and the outer circumferential surface of the sheet attraction belt 2 produces discharge products such as nitrogen oxide, and therefore the discharge products adhere to the sheet attraction belt 2. Then, as discharge products accumulates on the surface of the sheet attraction belt 2 due to long use of the sheet attraction belt 2, the sheet attraction belt 2 belt becomes more difficult to be charged, and therefore a sheet becomes more difficult to be electrostatically attracted to the sheet attraction belt 2.

In order to address this inconvenience, a cleaning blade is applicable to the sheet feeder 200 to scrape and remove discharge products adhering to the surface of the sheet attraction belt 2.

However, when the cleaning blade is used to remove the discharge products adhering to the surface of the sheet attraction belt 2, the cleaning blade contacts the sheet attraction belt 2 at high contact pressure. Accordingly, due to the high contact pressure of the cleaning blade to the surface of the sheet attraction belt 2, the front surface layer 2*a* of the sheet attraction belt 2 is worn away by the cleaning blade.

As described above, the front surface layer 2*a* of the sheet attraction belt 2 has a thickness of tens of micrometers, for example, about 15 μm in the present example. Therefore, the front surface layer 2*a* of the sheet attraction belt 2 disappears to expose the conductive layer, i.e., the back surface layer 2*b*. Once the conductive layer is exposed, the sheet attraction belt 2 cannot hold electric charge on the surface, and therefore fails to attract the sheet electrostatically. Specifically, in image forming apparatuses for product printing in which a large number of sheets are fed serially, the service life of the sheet attraction belt 2 becomes short, and therefore the sheet attraction belt 2 is likely to be frequently replaced to a new one.

In order to avoid this inconvenience, the sheet attraction belt 2 provided to an image forming apparatus used for product printing has good durability of 9000K or more sheets.

However, long-term continuous charging decreases the level of sheet attraction by discharge products, and therefore the durability of the sheet attraction belt 2 could not achieve the level of 9000K or more sheets in the durability test.

To eliminate the above-described inconvenience, it is noted and focused on that discharge products such as nitrogen oxide are water soluble. Based on the fact, a test was conducted using procedures in which water-containing liquid that functions as a discharge products remover was sprayed to the sheet attraction belt 2 and wiped the sprayed water-containing liquid adhering to the sheet attraction belt 2 was conducted. As a result, the discharge products on the sheet attraction belt 2 was found to have been removed preferably. The water-soluble discharge products was dissolved in the liquid sprayed on the surface of the sheet attraction belt 2. Then, by wiping the water-containing liquid supplied to the sheet attraction belt 2, the discharge products dissolved in the water-containing liquid was likely to be removed.

Accordingly, in order to remove the discharge products adhering to the surface of the sheet attraction belt 2, the configuration according to the present example includes a liquid supplier to supply water-containing liquid to the sheet attraction belt 2 and a liquid remover to remove the water-containing liquid supplied to the sheet attraction belt 2 from the sheet attraction belt 2.

Figure 10:
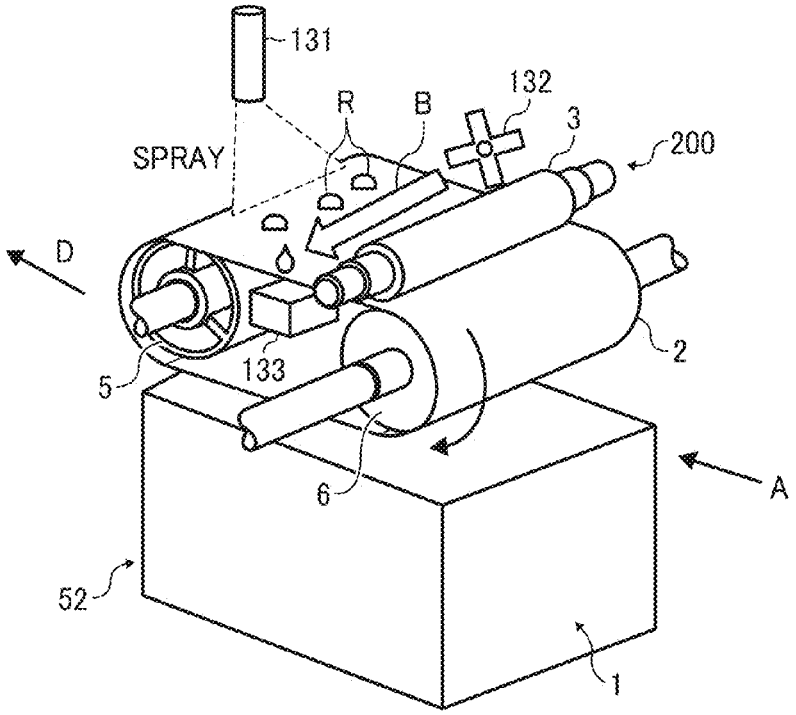
FIG. 10 is a schematic perspective view illustrating the configuration of the sheet feeding device according to an example of this disclosure, including the sheet feeder with a liquid supplier and a liquid remover.
Figure 11:
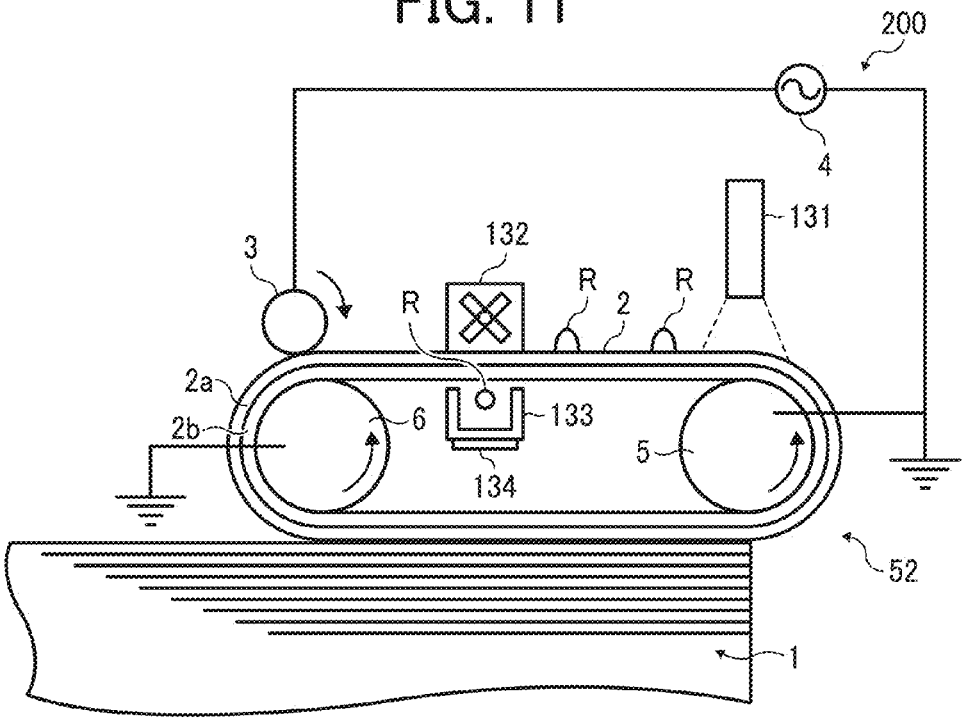
FIG. 11 is a front view illustrating the configuration of the sheet feeding device of FIG. 10.
Figure 12:
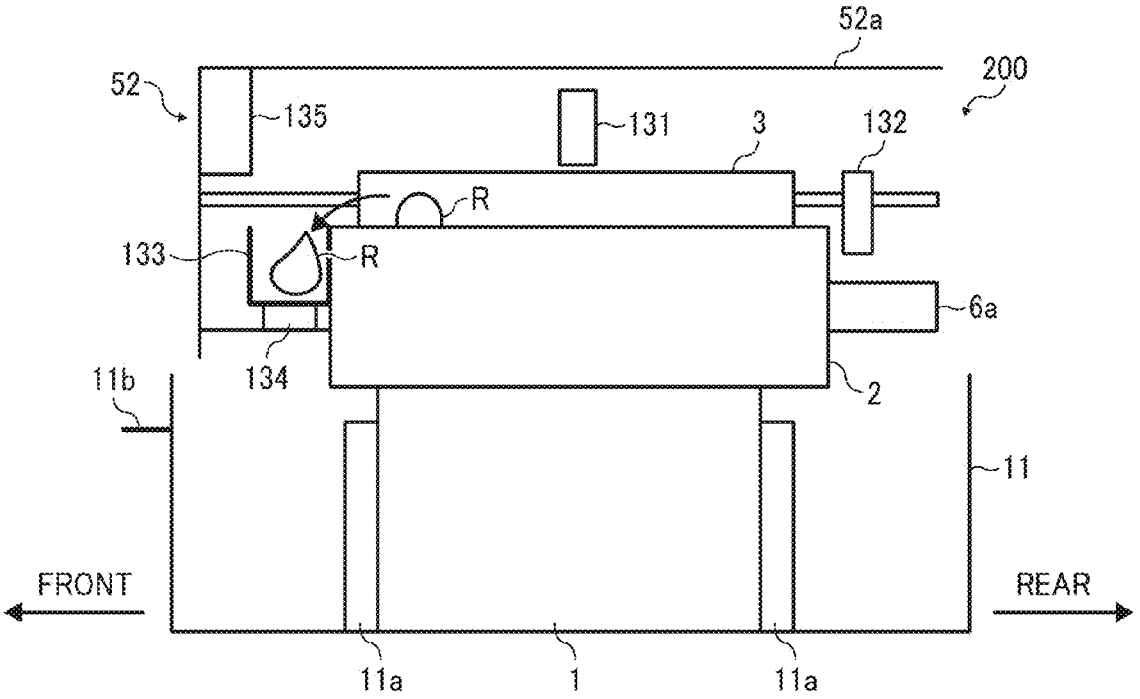
FIG. 12 is a diagram illustrating the configuration of the sheet feeding device of FIG. 10, viewed from a direction indicated by arrow A.

A description is given of the detailed configurations of the liquid supplier and the liquid remover with reference to FIGS. 10, 11, and 12.

FIG. 10 is a schematic perspective view illustrating the sheet feeding device 52 according to the present example of this disclosure. FIG. 11 is a front view illustrating the sheet feeding device 52 according to the present example of this disclosure. FIG. 12 is a diagram illustrating a schematic configuration of the sheet feeding device 52 of FIG. 10, viewed from a direction indicated by arrow A.

In the present example, the sheet feeder 200 of the sheet feeding device 52 includes a spraying device 131 and a blowing device 132. The spraying device 131 functions as a liquid supplier to supply liquid that contains water to the sheet attraction belt 2. The blowing device 132 functions as a liquid remover to remove the liquid on the sheet attraction belt 2 from the sheet attraction belt 2 by blowing.

It is to be noted that the term "liquid" indicates water-containing liquid or liquid that contains water.

The spraying device 131 is disposed over an upper region of two regions of the sheet attraction belt 2 wound around the upstream side tension roller 6 and the downstream side tension roller 5. In other words, the spraying device 131 is disposed above a region of the sheet attraction belt 2 where the region is not located facing the bundle of sheets 1.

The blowing device 132 is disposed between the spraying device 131 and the belt charger 3, at one end side in the width direction of the sheet attraction belt 2.

In the present example, the belt charger 3 is disposed facing the upstream side tension roller 6. However, the position of the belt charger 3 is not limited thereto. For example, as illustrated in FIG. 7, the belt charger 3 may be disposed facing the downstream side tension roller 5.

In the present example, the sheet feeder 200 of the sheet feeding device 52 further includes a liquid collecting device 133 and a heater 134. The liquid collecting device 133 collects liquid on the sheet attraction belt 2 blown by the blowing device 132 that is an air blowing device. The heater 134 evaporates the liquid collected by liquid collecting device 133.

Further, as illustrated in FIG. 12, the sheet feeding device 52 includes a device body 52*a*. The device body 52*a* includes a dehumidifying device 135 to dehumidify or remove liquid or moist air from the air around the sheet feeding device 52. A moisture absorbent or a desiccant such as Zeolite is employed as the dehumidifying device 135.

Further, as illustrated in FIG. 12, the sheet tray 11 includes a pair of side fences 11*a* and a handle 11*b*. The pair of side fences 11*a* regulates or restrains a position of the bundle of sheets 1 in the width direction. The handle 11*b* is provided for a user to grab when the user pulls out the sheet tray 11.

The spraying device 131 sprays liquid droplets R onto the surface of the sheet attraction belt 2. Discharge products such as nitrogen oxide adhering to the sheet attraction belt 2 is dissolved into the liquid droplets R. The blowing device 132 that is disposed downstream from the spraying device 131 in a direction of movement of the surface of the sheet attraction belt 2 produces airflow by blowing. The airflow flows from one end side to the other end side in the width direction of the sheet attraction belt 2 along the surface of the sheet attraction belt 2. The surface of the sheet attraction belt 2 has high water repellency, and therefore the airflow causes the liquid droplet R containing the discharge products to flow toward the other end side in the width direction of the sheet attraction belt 2, as indicated by arrow B in FIG. 10.

A liquid collecting device 133 is disposed at the other end side in the width direction of the sheet attraction belt 2. After having flown to the other end side in the width direction of the sheet attraction belt 2 by the blowing device 132, the liquid droplet R that contains the discharge products falls into the liquid collecting device 133. Consequently, the discharge products are removed from the sheet attraction belt 2 together with the liquid droplets R. As a result, the sheet attraction belt 2 is prevented from accumulation of discharge products to result in difficult charging of the sheet attraction belt 2. Accordingly, good sheet attraction by the sheet attraction belt 2 lasts for a long period of time. Therefore, even after printing 9000K or more sheets, the sheet attraction belt 2 attracted the sheet electrostatically, and the durability of the sheet attraction belt 2 could achieve the level of 9000K or more sheets.

The blowing device 132 preferably moves the liquid droplets R on the sheet attraction belt 2 preferably at a contact angle of 90 degrees or greater when the sheet attraction belt 2 contacts the liquid droplet R. Therefore, the front surface layer 2*a* of the sheet attraction belt 2 is preferably made of an insulating material having high water repellent performance at the contact angle of 90 degrees or greater between the liquid droplet R and the sheet attraction belt 2.

Further, since the blowing device 132 generates the airflow to blow the liquid droplets R containing the discharge products that are collected from the surface of the sheet attraction belt 2 and are dissolved in each liquid droplet R, the liquid droplets R sprayed on the surface of the sheet attraction belt 2 can be removed without contacting the surface of the sheet attraction belt 2. Accordingly, the front surface layer 2*a* of the sheet attraction belt 2 can be prevented from abrasion, and therefore the sheet can be electrostatically attracted to the surface of the sheet attraction belt 2 reliably for a long period of time.

It is likely that, when the sheet attraction belt 2 with the liquid droplets R holding on the surface thereof is moving the region facing the bundle of sheets 1, the liquid droplet R falls from the sheet attraction belt 2 onto the bundle of sheets 1, resulting in wetting the bundle of sheets 1.

In order to address this inconvenience, in the present example, before the sheet attraction belt 2 having the liquid droplets R on the surface thereof reaches the region facing the bundle of sheets 1, the liquid droplets R are removed from the surface of the sheet attraction belt 2. Accordingly, this configuration can prevent the liquid droplet R from falling from the sheet attraction belt 2 onto the bundle of sheets 1, and therefore can prevent from wetting the bundle of sheets 1.

As illustrated in FIGS. 11 and 12, a heater 134 is disposed at the bottom of the liquid collecting device 133. The heater 134 heats and evaporates the liquid droplets R collected by the liquid collecting device 133. Since the heater 134 heats and evaporates the liquid droplets R collected by the liquid collecting device 133, maintenance work to take out the liquid collecting device 133 from the sheet feeding device 52 at a regular basis and throw away the liquid stored in the liquid collecting device 133 can be eliminated.

Alternatively, the liquid collecting device 133 can be installed removably from the sheet feeding device 52, so that the liquid collecting device 133 can be taken out from the sheet feeding device 52 at a regular basis and throw away the liquid in the liquid collecting device 133. In this case, the heater 134 or other heating device can be omitted, and therefore a reduction in cost of the image forming apparatus 100 and energy saving of the image forming apparatus 100 can be enhanced.

As another alternative configuration, the liquid droplets R collected by the liquid collecting device 133 can be returned to the spraying device 131.

Further, depending on the configuration and operating environment of an image forming apparatus, discharge products onto a sheet attraction belt may accumulate slowly. In this case, an operation from when liquid that contains water is supplied to adhere to the sheet attraction belt to when discharge products are removed can be performed in a long cycle. Therefore, the liquid collected by the liquid collecting device 133 may evaporate naturally before the discharge products are mechanically removed. In such a device, the heater 134 can be omitted.

Further, evaporation of the liquid collected by the liquid collecting device 133 increases moist air in the sheet feeding device 52. As the moist air in the sheet feeding device 52 increases, the charge patterns formed on the surface of the sheet attraction belt 2 cannot be maintained. Therefore, it is likely that the sheet is difficult to be attracted to the sheet attraction belt 2. Therefore, in the present example, the dehumidifying device 135 is provided to the device body 52*a* of the sheet feeding device 52 to remove humidity or moist air from an ambient atmosphere of the sheet feeding device 52. Consequently, the dehumidifying device 135 provided to the sheet feeding device 52 prevents the level of moist air of the ambient atmosphere of the sheet feeding device 52 (also referred to as an ambient humidity of the sheet feeding device 52) from increasing. As a result, the charge patterns formed on the surface of the sheet attraction belt 2 can be maintained reliably, and therefore the sheet can be attracted to the sheet attraction belt 2.

Further, the dehumidifying device 135 in the present example is disposed above or at a position higher than the liquid collecting device 133. Therefore, water vapor evaporated from the liquid collecting device 133 can be absorbed to the dehumidifying device 135 efficiently. Even in a configuration in which the heater 134 is not provided to evaporate the liquid collected by the liquid collecting device 133, if the spraying device 131 sprays liquid to the sheet attraction belt 2, the ambient humidity of the sheet feeding device 52 is likely to increase. Accordingly, even in the configuration without the heater 134 provided for evaporating the liquid collected by the liquid collecting device 133, it is preferable to provide the dehumidifying device 135 to remove moist air from the ambient atmosphere of the sheet feeding device 52.

The spraying device 131 is designed to spray liquid over at least a region in the width direction of the sheet attraction belt 2 where the charge patterns are formed. In other words, the spraying device 131 sprays liquid over a region to which the belt charger 3 applies electric charge.

The spraying device 131 illustrated in FIGS. 11 and 12 sprays liquid over the entire region in the width direction of the sheet attraction belt 2. However, the configuration of the spraying device 131 is not limited thereto. For example, multiple spraying devices are aligned in the width direction of the sheet attraction belt 2 to spray liquid over the entire region in the width direction of the sheet attraction belt 2.

By spraying liquid to the sheet attraction belt 2, small liquid droplets can be distributed over the entire region in the width direction of the sheet attraction belt 2, and therefore discharge products adhering to the surface of the sheet attraction belt 2 can be removed reliably.

Further, liquid can be sprayed over the surface of the sheet attraction belt 2 without contacting the sheet attraction belt 2. Therefore, abrasion of the front surface layer 2*a* of the sheet attraction belt 2 can be prevented.

Figure 13:
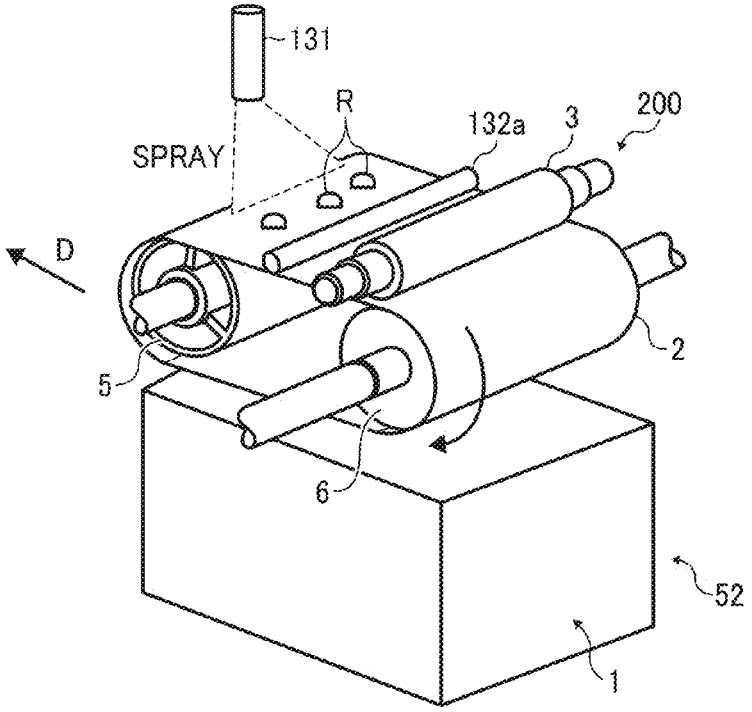
FIG. 13 is a perspective view illustrating the sheet feeder in the sheet feeding device with another liquid remover.

Further, as illustrated in FIG. 13, a liquid absorbing member 132*a* is provided to contact the surface of the sheet attraction belt 2, so that the liquid absorbing member 132*a* can remove the liquid droplets R on the surface of the sheet attraction belt 2. Porous materials such as web and sponge can be used as the liquid absorbing member 132*a*.

As illustrated in FIGS. 10 through 12, when the airflow is used to blow the liquid droplets R away from the sheet attraction belt 2, the liquid droplets R may contact each other, which can result in splashing the liquid droplets R on the surface of the sheet attraction belt 2 and then falling onto the bundle of sheets 1. When the liquid absorbing member 132*a* is used to absorb and remove the liquid droplets R from the surface of the sheet attraction belt 2, splash of the liquid droplets R can be avoided, and therefore the bundle of sheets 1 can be prevented from being wet by the splashed liquid droplets R.

Figure 14:
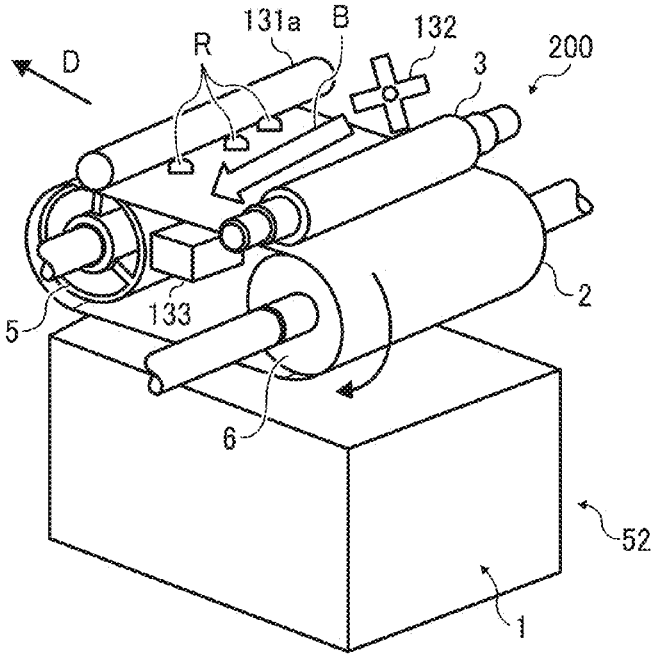
FIG. 14 is a perspective view illustrating the sheet feeder in the sheet feeding device with another liquid supplier.
Figure 15:
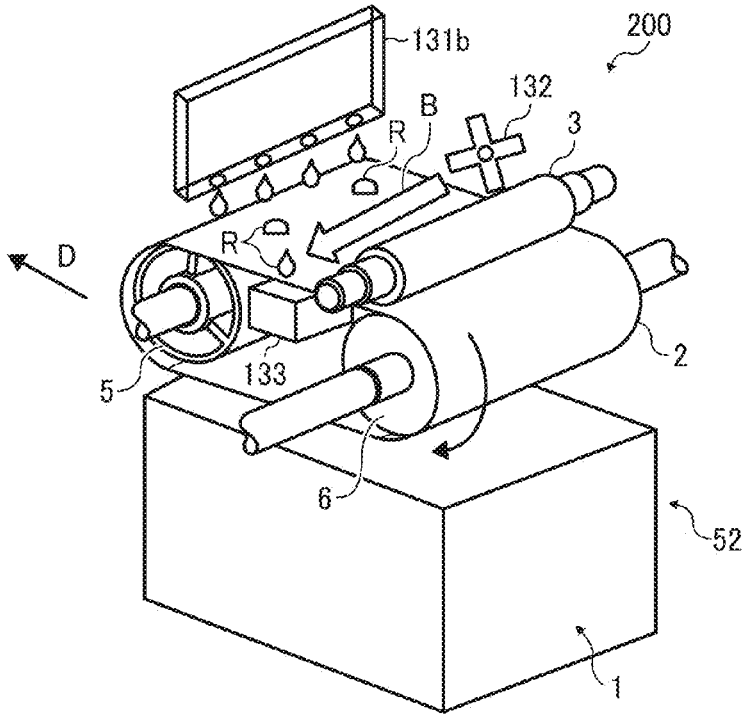
FIG. 15 is a perspective view illustrating the sheet feeder in the sheet feeding device with yet another liquid supplier.

FIG. 13 is a perspective view illustrating the sheet feeder 200 in the sheet feeding device 52 with another liquid remover. FIG. 14 is a perspective view illustrating the sheet feeder 200 in the sheet feeding device 52 with another liquid supplier. FIG. 15 is a perspective view illustrating the sheet feeder 200 in the sheet feeding device 52 with yet another liquid supplier.

When supplying liquid to the sheet attraction belt 2, a liquid containing member 131*a* can be employed, as illustrated in FIG. 14. As the liquid containing member 131*a* contacts and presses the sheet attraction belt 2, liquid seeps out or comes out from the liquid containing member 131*a* to supply the liquid over the surface of the sheet attraction belt 2. Porous materials such as sponge may be employed as the liquid containing member 131*a*. The liquid containing member 131*a* has a multilayer construction that includes a surface layer and an inner layer. The inner layer includes a water holding material. The surface layer includes superabsorbent material in a gelatinous form after absorbing liquid such as superabsorbent polymer. The liquid seeped out from the gelatinous superabsorbent material can be supplied to the surface of the sheet attraction belt 2.

When the spraying device 131 is used to supply liquid to the surface of the sheet attraction belt 2, water mist flows in the air surrounding the sheet feeding device 52. Therefore, the ambient humidity of the sheet feeding device 52 can increase easily. By contract, the liquid containing member 131*a* in FIG. 14 contacts the surface of the sheet attraction belt 2. Therefore, in comparison with the configuration using the spraying device 131, the configuration including the liquid containing member 131*a* can prevent the ambient humidity of the sheet feeding device 52 from increasing.

It is to be noted that liquid can be supplied to the sheet attraction belt 2 sufficiently by the liquid containing member 131*a* contacting to the surface of the sheet attraction belt 2, and therefore the sheet attraction belt 2 can be prevented from being worn away when compared with the configuration in which the cleaning blade scrapes and removes the discharge products adhering to the surface of the sheet attraction belt 2.

Alternatively, as illustrated in FIG. 15, a droplet discharging device 131*b* may be provided to discharge liquid droplets to the sheet attraction belt 2, so as to supply liquid over the surface of the sheet attraction belt 2. The droplet discharging device 131*b* illustrated in FIG. 15 is disposed facing the entire region in the width direction of the sheet attraction belt 2, so that liquid droplets can be discharged over the entire region in the width direction of the sheet attraction belt 2. However, the configuration is not limited thereto. For example, the droplet discharging device 131*b* may be disposed so as to discharge liquid droplets on a single side in the width direction of sheet attraction belt 2 where the blowing device 132 is disposed. This configuration of the sheet feeder 200 can achieve the same effect as the above-described configurations in removing discharge products from the entire region in the width direction of the sheet attraction belt 2. Specifically, the liquid droplets adhering to the side near the blowing device 132 in the width direction of the sheet attraction belt 2 move on the surface of the sheet attraction belt 2 from the blowing device 132 through the liquid collecting device 133 by the airflow generated by the blowing device 132. According to this movement of the liquid droplets, the discharge products are dissolved into each liquid droplet on the surface of the sheet attraction belt 2. Therefore, the discharge products can be removed from the entire region in the width direction of the sheet attraction belt 2.

Figure 16:
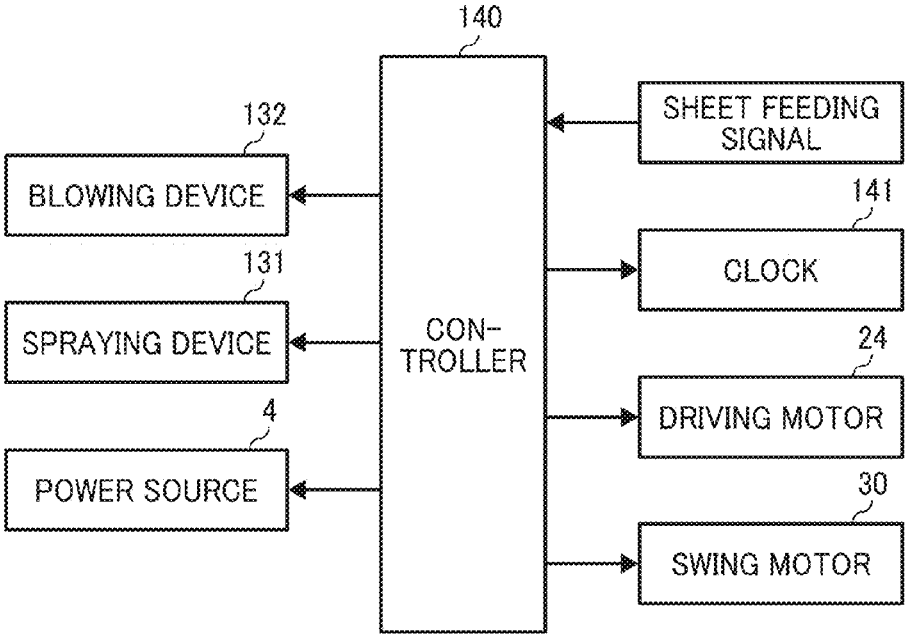
FIG. 16 is a block diagram illustrating a controller that controls the sheet feeding operation and related devices connected to the controller.

FIG. 16 is a block diagram illustrating a controller 140 that controls the sheet feeding operation and related devices connected to the controller 140.

As illustrated in FIG. 16, the sheet feeding device 52 includes the controller 140 to control a sheet feeding operation to feed the sheets and a products removing operation to remove discharge products. The controller 140 is a computer including a central processing unit (CPU), a memory, and a communication interface.

The controller 140 is connected to a clock 141, the driving motor 24 to drive and rotate the sheet attraction belt 2, the swing motor 30 to swing the sheet attraction and separation unit 110, the power supply 4 to apply the alternating voltage to the belt charger 3, the spraying device 131 functioning as a liquid supplier, and the blowing device 132 functioning as a liquid remover. The CPU of the controller 140 controls the sheet feeding operation and the products removing operation according to a program stored in the memory.

Figure 17:
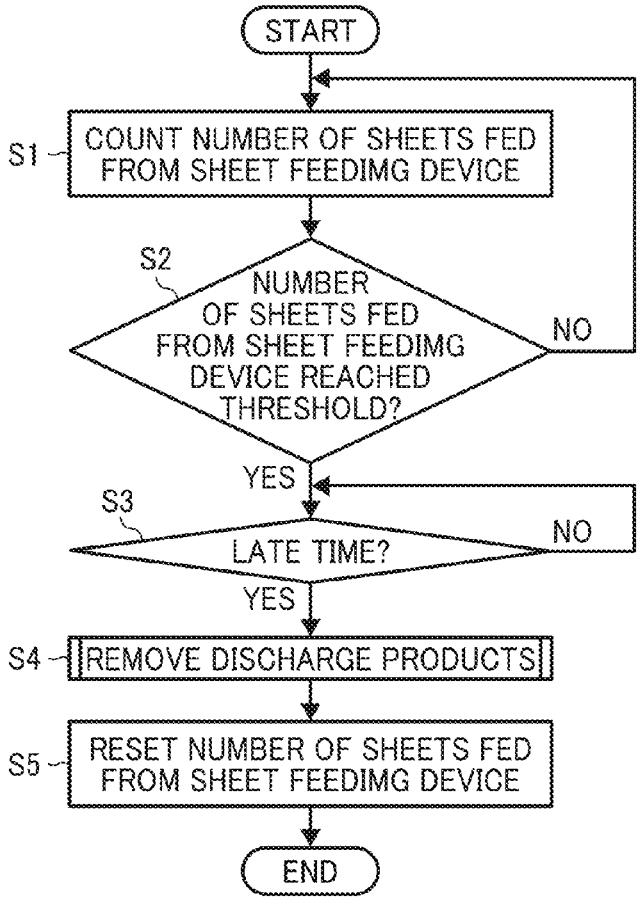
FIG. 17 is a flowchart of a removing operation of discharge products.

FIG. 17 is a flowchart of the products removing operation of discharge products.

On receipt of the sheet feeding signal, the controller 140 increments a count value to count up the number of sheets fed from the sheet feeding device 52 in step S1. The count value is stored in the memory of the controller 140.

In the present example, the controller 140 counts up the number of sheets fed from the sheet feeding device 52 to estimate the level (amounts) of adhesion of discharge products to the sheet attraction belt 2. However, the method of estimating the level of adhesion of discharge products is not limited thereto. For example, the controller 140 can estimate the level of adhesion of discharge products to the sheet attraction belt 2 based on an accumulated mileage or an accumulated traveling distance of the sheet attraction belt 2 or an accumulated value at a power on time of the power supply 4.

In step S2, the controller 140 determines whether or not the number of sheets fed from the sheet feeding device 52 has reached or exceeded a predetermined threshold value (for example, 10K sheets).

When the number of sheets fed from the sheet feeding device 52 has not yet reached or exceeded the predetermined threshold (NO in step S2), the controller 140 repeats the procedure of step S1.

When the number of sheets fed from the sheet feeding device 52 has reached or exceeded the predetermined threshold (YES in step S2), the controller 140 confirms the time of the controller 140 in step S3.

When the time of the clock 141 indicates late period of time that is a period of time any user generally does not use the image forming apparatus 100 (for example, a predetermined time between 2 AM and 4 AM) (YES in step S3), the controller 140 starts the products removing operation of the discharge products in step S4. Specifically, the controller 140 controls the driving motor 24 to rotate the sheet attraction belt 2. Then, the controller controls the spraying device 131 functioning as a liquid supplier to supply liquid droplets R over the surface of the sheet attraction belt 2. Thereafter, the controller 140 controls the blowing device 132 functioning as a liquid remover to remove the liquid droplets R from the surface of the sheet attraction belt 2. After rotating the sheet attraction belt 2 for the entire cycle, the controller 140 causes the spraying device 131 to stop supplying liquid droplets R, and then the blowing device 132 to stop removal of the discharge products. Then, the controller 140 stops rotating the sheet attraction belt 2. At completion of the products removing operation of discharge products, the controller 140 resets the count value, which corresponds to the number of sheets fed from the sheet feeding device 52, stored in the memory in step S5.

When the number of sheets fed from the sheet feeding device 52 has not yet reached or exceeded the predetermined threshold (NO in step S3), the controller 140 repeats the procedure of step S3.

Figure 18:
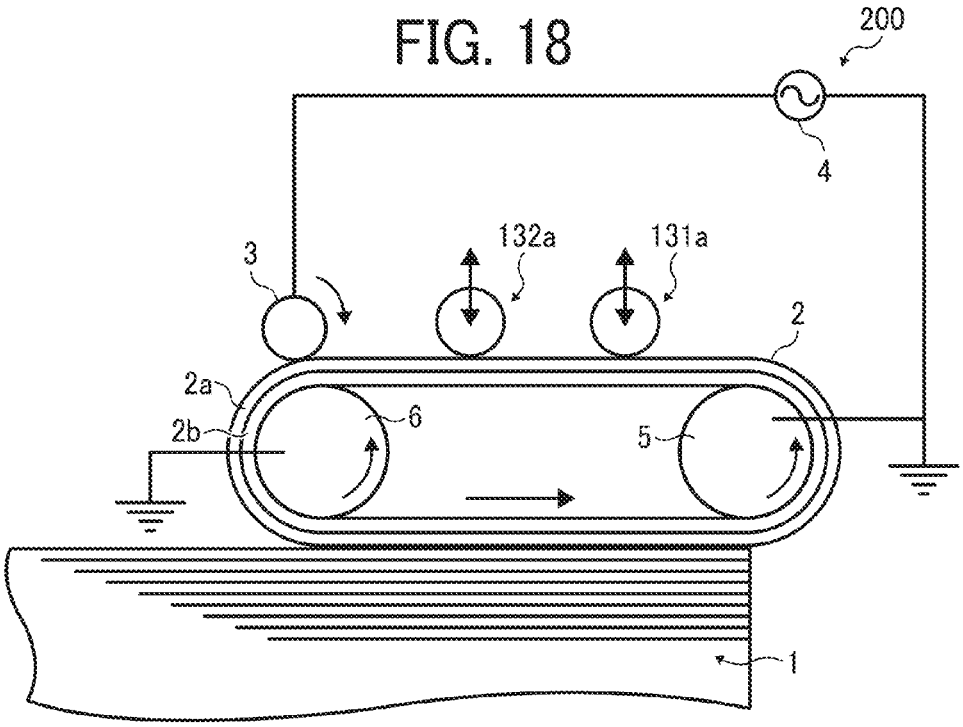
FIG. 18 is a diagram illustrating the products removing operation of the discharge products in a case in which the liquid supplier and/or the liquid remover contact the sheet attraction belt.

FIG. 18 is a diagram illustrating the products removing operation of the discharge products in a case in which a liquid containing member 131*a* and/or a liquid absorbing member 132*a* contact the sheet attraction belt 2.

In a case in which when the liquid contacting member 131*a* is employed as a liquid supplier to supply liquid to the sheet attraction belt 2 by contacting the sheet attraction belt 2 as illustrated in FIG. 14 or when the liquid absorbing member 132*a* is employed as a liquid remover to remove liquid from the sheet attraction belt 2 by contacting the sheet attraction belt 2 as illustrated in FIG. 13, the liquid containing member 131*a* and/or the liquid absorbing member 132*a* are disposed to be contactable with the sheet attraction belt 2. When removing products other than the discharge products, the liquid containing member 131*a* and/or the liquid absorbing member 132*a* are disposed separated from the sheet attraction belt 2. When removing the discharge products, the liquid containing member 131*a* and/or the liquid absorbing member 132*a* contact the sheet attraction belt 2.

As described above, the liquid containing member 131*a* and/or the liquid absorbing member 132*a* contact with the sheet attraction belt 2 when removing the discharge products but do not when removing any products other than the discharge products, the sheet attraction belt 2 can be protected from being worn away.

While the products removing operation of the discharge products is being performed, the sheet conveying operation cannot be performed, and therefore the downtime of the image forming apparatus 100 occurs. In addition, spraying liquid containing water, the ambient humidity of the sheet feeding device 52 increases. Further, when a user hits or bumps against the image forming apparatus 100, shock is applied to the image forming apparatus 100. Therefore, it is likely that the liquid droplets R held on the surface of the sheet attraction belt 2 fall from the sheet attraction belt 2 onto the bundle of sheets 1, resulting in wetting the bundle of sheets 1. In order to address this inconvenience, even when the number of sheets fed from the sheet feeding device 52 reaches or exceeds the threshold value, the products removing operation of the discharge products is not performed promptly but is performed in a late period of time when users do not generally use the image forming apparatus 100. Consequently, suspension of the sheet conveying operation due to performance of the products removing operation of the discharge products can be prevented. Further, by performing the products removing operation of the discharge products during the late period of time, even if the ambient humidity of the sheet feeding device 52 increases due to the products removing operation of the discharge products, the ambient humidity of the sheet feeding device 52 is reduced by the following morning when the users start using the image forming apparatus 100. With this configuration, defects of sheet attraction to the sheet attraction belt 2 due to increase of the ambient humidity of the sheet feeding device 52 can be restrained.

Further, by performing the products removing operation in the late period of time when users do not generally use the image forming apparatus 100, the shock caused by the users bumping against the image forming apparatus 100 can be avoided. Therefore, the products removing operation of the discharge products can be performed reliably. Accordingly, with the above-described configuration, the liquid droplets R adhering to the sheet attraction belt 2 can be prevented from falling from the sheet attraction belt 2 onto the bundle of sheets 1, and therefore can be prevented from wetting the bundle of sheets 1.

Further, the performance of the products removing operation of the discharge products is withheld until the late period of time. Therefore, the threshold value of the number of sheets fed from the sheet feeding device 52 is set with a rather value allowance that can affect on sheet attraction due to adhesion of discharge products. For example, in a case in which the image forming apparatus is used for product printing for performing a large amount of image formation per day, the products removing operation of the discharge products can be set to perform in the late period of time each day without counting the number of sheets fed from the sheet feeding device 52. It is needless to say that the products removing operation of the discharge products can be alternatively set to perform as soon as the number of sheets fed from the sheet feeding device 52 reaches the threshold value, without waiting for the late period of time.

Figure 19:
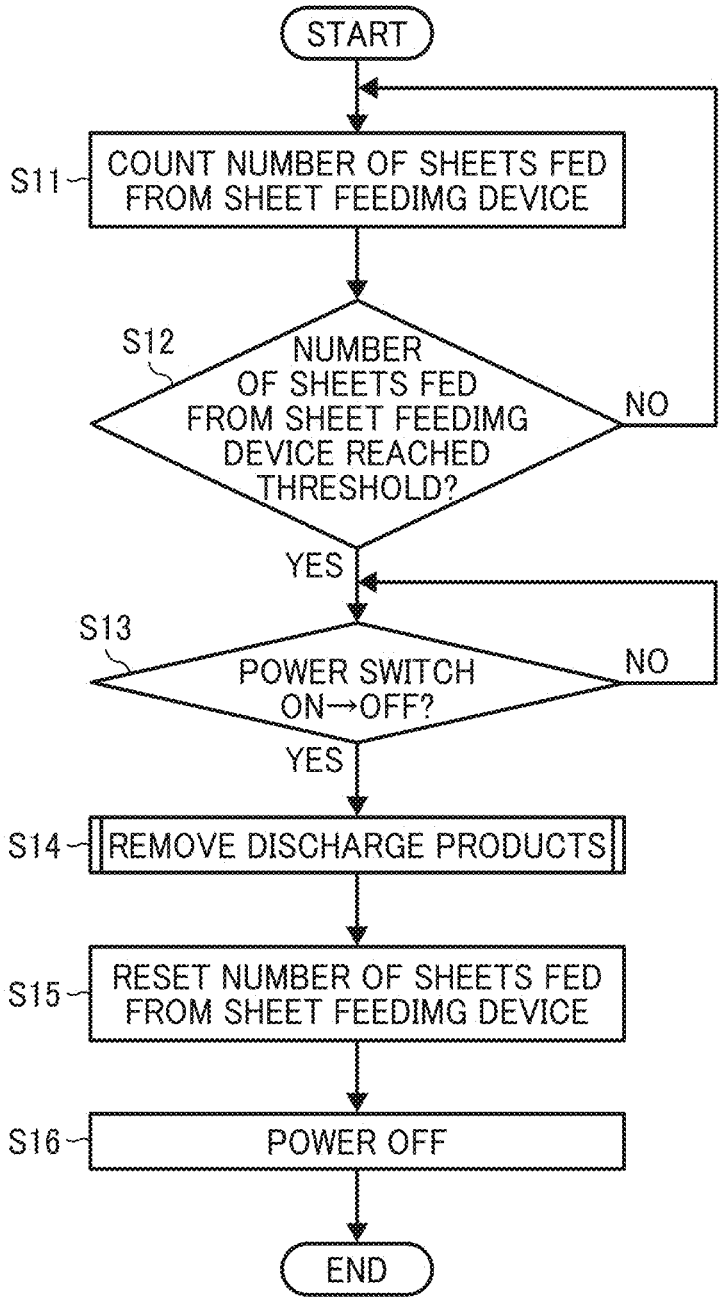
FIG. 19 is a flowchart of another removing operation of discharge products.

FIG. 19 is a flowchart of another removing operation of discharge products.

As shown in the flowchart in FIG. 19, on receipt of the sheet feeding signal, the controller 140 increments the count value to count up the number of sheets fed from the sheet feeding device 52 in step S11. The count value is stored in the memory of the controller 140.

In step S12, the controller 140 determines whether or not the number of sheets fed from the sheet feeding device 52 has reached or exceeded a predetermined threshold value.

When the number of sheets fed from the sheet feeding device 52 has not yet reached or exceeded the predetermined threshold (NO in step S12), the controller 140 repeats the procedure of step S11.

When the number of sheets fed from the sheet feeding device 52 has reached or exceeded the predetermined threshold (YES in step S12), the controller 140 determines whether or not any instruction to turn the power switch from on to off is sent.

When no instruction to turn the power switch is issued (NO in step S13), the controller 140 repeats the procedure of step S13.

When the instruction to turn off the power switch is issued (YES in step S13), the controller 140 causes the liquid remover to perform the products removing operation of the discharge products in step S14.

At completion of the products removing operation of discharge products, the controller 140 resets the count value, which corresponds to the number of sheets fed from the sheet feeding device 52, stored in the memory in step S15, and then turns off (shutdown) the power supply in step S16.

In a case in which the power supply is turned off as described above, the image forming apparatus 100 is generally not used for a while. Consequently, by performing the products removing operation of the discharge products at issuance of the instructions to turn off the power supply, suspension of the sheet conveying operation due to performance of the products removing operation of the discharge products can be prevented. Further, by performing the products removing operation of the discharge products while the power supply is turned off, even if the ambient humidity of the sheet feeding device 52 increases due to the products removing operation of the discharge products, the ambient humidity of the sheet feeding device 52 is reduced by the time the user turns on the power supply to start the image forming apparatus 100 again. Accordingly, with this configuration, defects of sheet attraction to the sheet attraction belt 2 due to increase of the ambient humidity of the sheet feeding device 52 can be restrained.

Further, in a case in which the image forming apparatus 100 is used in office, the last person usually turns off the switch of the image forming apparatus 100 before leaving the office. In other words, after the power of the image forming apparatus 100 is turned off, no one generally remains around the image forming apparatus 100. Therefore, no shock is not applied to the image forming apparatus 100, and therefore the liquid droplets R adhering to the sheet attraction belt 2 can be prevented from falling from the sheet attraction belt 2 onto the bundle of sheets 1. Consequently, the bundle of sheets 1 can be prevented from being wet.

Further, if the image forming apparatus is used for product printing for performing a large amount of image formation, the products removing operation of the discharge products can be set to perform each time the instruction to turn off the power supply is issued.

The products removing operation of the discharge products is performed in a state in which the sheet attraction belt 2 is at the sheet separation position. At this time, since the upstream side tension roller 6 is located at a lower position than the downstream side tension roller 5, it is likely that the liquid on the surface of the sheet attraction belt 2 flows down toward the upstream side tension roller 6. In order to address this inconvenience, a lifting device may be provided to lift the upstream side tension roller 6, so that the lifting device can lift the upstream side tension roller 6 to make the upper face of the sheet attraction belt 2 horizontal before performing the products removing operation of the discharge products.

Further, as illustrated in FIGS. 10 through 15, the belt charger 3 can be disposed upstream from the liquid remover and the liquid supplier in the sheet conveying direction. By so doing, the liquid supplier and the liquid remover can be disposed between the sheet separation position of the sheet attraction belt 2 and a charging position at which the electric charge is applied to the sheet attraction belt 2. If the liquid adheres to the sheet attraction belt 2, the charge patterns formed on the surface of the sheet attraction belt 2 are eliminated by the belt charger 3. However, when the belt charger 3 is disposed upstream from the liquid remover and the liquid supplier in the sheet conveying direction, the charge patterns formed on the surface of the sheet attraction belt 2 by the belt charger 3 remain and pass through the opposing region facing the bundle of sheets 1, and through the liquid remover and the liquid supplier. Therefore, even if the liquid supplier applies the liquid to the sheet attraction belt 2 in the sheet conveying operation and then the products removing operation of the discharge products is performed, definite charge patterns are formed on the surface of the sheet attraction belt 2 in the opposing region facing the bundle of sheets 1. As a result, the uppermost sheet 1*a* of the bundle of sheets 1 can be attracted to the sheet attraction belt 2 and conveyed reliably. Consequently, by disposing the belt charger 3 upstream from the liquid remover and the liquid supplier in the sheet conveying direction, the products removing operation of the discharge products can be performed even while the sheet conveying operation is performed, and therefore the downtime of the image forming apparatus 100 can be prevented.

It is to be noted that any liquid containing water or water can be used as discharge products removing liquid to remove the discharge products from the sheet attraction belt 2. Further, the discharge products removing liquid is not limited to liquid containing water or water but any liquid can be applied as long as the discharge products can be dissolved in the liquid.

This configurations according to the above-descried examples are not limited thereto. This disclosure can achieve the following aspects effectively.

Aspect 1.

In Aspect 1, a sheet feeder such as the sheet feeder 200 includes an attraction body, a charger, a liquid supplier, and a liquid remover. The attraction body (for example, the sheet attraction belt 2) is disposed facing an upper surface of a bundle of sheets (for example, the bundle of sheets 1) including an uppermost sheet (for example, the uppermost sheet 1*a*). The charger (for example, the belt charger 3 and the power supply 4) is disposed above the attraction body and charges a surface of the attraction body such that the attraction body electrostatically attracts the uppermost sheet of the bundle of sheets. The liquid supplier (for example, the spraying device 131) supplies a liquid to the attraction body. The liquid is to dissolve discharge products. The liquid remover (for example, the blowing device 132) removes the liquid supplied by the liquid supplier from the attraction body.

According to this configuration, as described in the above-described examples, the liquid supplier supplies liquid in which discharge products are dissolved such as water containing liquid to the attraction body, and therefore the discharge products such as nitrogen oxide adhering to the surface of the attraction body are dissolved in the liquid. The liquid in which the discharge products are dissolved is removed from the attraction belt by the liquid remover. Therefore, the discharge products can be removed from the attraction body. As a result, the attraction body can be charged reliably for a long period of time, and the sheet can be attracted electrostatically to the attraction body reliably over a long period of time.

Aspect 2.

In Aspect 1, the liquid contains water.

According to this configuration, the discharge products such as the water soluble nitrogen oxide can be dissolved in the liquid, and can remove the discharge products from the attraction body reliably.

Aspect 3.

In Aspect 1 or Aspect 2, the liquid supplier (for example, the spraying device 131) supplies the liquid without contacting the attraction body (for example, the sheet attraction belt 2).

According to this configuration, as described in the above-described examples, the attraction body can be prevented from being worn away in comparison with the configuration in which a supplying member contacts the attraction body when applying the liquid in which discharge products can be dissolved such as water.

Aspect 4.

In Aspect 3, the liquid supplier (for example, the spraying device 131) sprays the liquid in which discharge products can be dissolved to the attraction body (for example, the sheet attraction belt 2).

According to this configuration, as described in the above-described examples, the liquid supplier can supply the liquid in which the discharge products can be dissolved, to the attraction body without contacting. Therefore, the attraction body can be prevented from being worn away.

Further, even if the surface of the attraction body has high water repellent performance, file liquid droplets can be distributed over the entire region in the width direction of the attraction body, and therefore the discharge products adhering to the surface of the attraction body can be removed reliably.

Aspect 5.

In any one of Aspects 1 through 4, the liquid remover (for example, the blowing device 132) removes the liquid supplied to the attraction body (for example, the sheet attraction belt 2) from the attraction body without contacting the attraction body.

According to this configuration, as described in the above-described examples, the attraction body can be prevented from being worn away in comparison with the configuration in which a removing member contacts the attraction body when removing the liquid in which discharge products can be dissolved such as water from the attraction body.

Aspect 6.

In Aspect 5, the liquid remover (for example, the blowing device 132) removes the liquid supplied to the attraction body (for example, the sheet attraction belt 2) by blowing.

According to this configuration, the liquid remover can remove the liquid in which the discharge products can be dissolved, from the attraction body without contacting the attraction body. Therefore, the attraction body can be prevented from being worn away.

Aspect 7.

In any one of Aspects 1 through 4, the liquid remover (for example, the blowing device 132) includes a liquid absorber (for example, the liquid absorbing member 132*a*) as at least a surface. The liquid absorber is a porous material member that absorbs and removes the liquid (for example, the liquid in which discharge products are dissolved) supplied and adhered to the attraction body (for example, the sheet attraction belt 2) from the attraction body.

According to this configuration, in comparison with the configuration in which a removing member removes the liquid in which discharge products can be dissolved such as water from the attraction body by blowing, the configuration described above with reference to FIG. 13 does not splash the liquid on the attraction body does not splash to the bundle of sheets, and therefore can prevent from wetting the bundle of sheets.

Aspect 8.

In any one of Aspects 1, 4, and 7, the liquid remover (for example, the blowing device 132) removes the liquid (for example, the liquid in which discharge products are dissolved). The liquid remover contacts the attraction body (for example, the sheet attraction belt 2) when the liquid remover removes the liquid supplied to the attraction body from the attraction body.

According to this configuration, as described with reference to FIG. 18, the attraction body can be prevented from being worn away due to friction caused by contacting with the liquid remover.

Aspect 9.

In any one of Aspects 1 through 8, the sheet feeder (for example, the sheet feeder 200) further includes a moist air remover (for example, the dehumidifying device 135) to remove moist air from an ambient atmosphere of the sheet feeder.

According to this configuration, as described in the above-described examples with reference to FIG. 12, even if the liquid (for example, the liquid in which discharge products are dissolved) removed from the attraction body (for example, the sheet attraction belt 2) evaporates, the moist air remover can absorb the evaporated vapor. Consequently, the moist air remover can prevent an ambient humidity of the sheet feeder from increasing.

Aspect 10.

In any one of Aspects 1 through 8, the sheet feeder (for example, the sheet feeder 200) further includes a liquid collector (for example, the liquid collecting device 133) to collect the liquid (for example, the liquid in which discharge products are dissolved) removed by the liquid remover (for example, the blowing device 132).

According to this configuration, the liquid removed from the attraction body (for example, the sheet attraction belt 2) by the liquid remover can be prevented from adhering to and wetting the bundle of sheets.

Aspect 11.

In any one of Aspects 1 through 10, the sheet feeder (for example, the sheet feeder 200) further includes a controller (for example, the controller 140) to estimate a level of adhesion of the discharge products (for example, based on the number of sheets fed from the sheet feeding device 52) to the attraction body (for example, the sheet attraction belt 2). The controller causes the liquid supplier to perform a liquid supplying operation and the liquid remover to perform a liquid removing operation when the level of adhesion of the discharge products to the attraction body is estimated to be a predetermined threshold value or higher.

According to this configuration, when compared with the configuration in which the liquid supplier constantly supplies the liquid and the liquid remover constantly removes the liquid, the discharge products can be removed from the attraction body efficiently.

Aspect 12.

In any one of Aspects 1 through 11, the sheet feeder (for example, the sheet feeder 200) further includes a controller (for example, the controller 140) to cause the liquid supplier to perform a liquid supplying operation and the liquid remover to perform a liquid removing operation in a late period of time.

Consequently, as described in the above-described examples with reference to FIG. 17, by performing the liquid supplying operation by the liquid supplier and the liquid removing operation by the liquid remover in the late period of time when an image forming apparatus including the sheet feeder is not generally used, suspension of the sheet conveying operation due to performance of the products removing operation of the discharge products can be prevented.

Further, even if the ambient humidity increases due to the products removing operation of the discharge products, the ambient humidity is reduced by the following morning when the users start using the image forming apparatus. Accordingly, with this configuration, defects of sheet attraction to the attraction body due to increase of the ambient humidity can be restrained.

Further, by performing the products removing operation in the late period of time when users do not generally use the image forming apparatus, the shock caused by the users bumping against the image forming apparatus can be avoided. Therefore, the products removing operation of the discharge products can be performed reliably. According to the above-described configuration, the liquid adhering to the attraction body can be prevented from falling from the attraction body onto the bundle of sheets, and therefore can be prevented from wetting the bundle of sheets.

Aspect 13.

In any one of Aspects 1 through 11, the sheet feeder (for example, the sheet feeder 200) further includes a controller (for example, the controller 140) to cause the liquid supplier to perform a liquid supplying operation and the liquid remover to perform a liquid removing operation at issuance of a power off instruction.

Consequently, as described in the above-described examples with reference to FIG. 18, by performing the liquid supplying operation by the liquid supplier and the liquid removing operation by the liquid remover when the power off instruction is issued to turn off the image forming apparatus thereafter the image forming apparatus is not used for a while, suspension of the sheet conveying operation due to performance of the products removing operation of the discharge products can be prevented. Further, by performing the products removing operation of the discharge products while the power supply is turned off, even if the ambient humidity increases due to the products removing operation of the discharge products, the ambient humidity is reduced by the time the user turns on the power supply to start the image forming apparatus again. Accordingly, with this configuration, defects of sheet attraction to the attraction body due to increase of the ambient humidity can be restrained. Further, in a case in which the image forming apparatus is used in office, the last person usually turns off the switch of the image forming apparatus before leaving the office. Therefore, after the power of the image forming apparatus is turned off, no one generally remains around the image forming apparatus in the office. Accordingly, the liquid adhering to the attraction body can be prevented from falling from the attraction body onto the bundle of sheets due to shock occurred when the user bumps the image forming apparatus, and therefore can be prevented from wetting the bundle of sheets.

Aspect 14.

In Aspect 14, an image forming apparatus (for example, the image forming apparatus 100) includes a sheet container (for example, the sheet tray 11) to accommodate the bundle of sheets, an image forming device (for example, the image forming device 50) to form an image on the uppermost sheet fed from the sheet container, and the sheet feeder according to any one of Aspects 1 through 13 to separate the uppermost sheet (for example, the uppermost sheet 1*a*) from the bundle of sheets (for example, the bundle of sheets 1) in the sheet container and supply the uppermost sheet to the image forming device.

According to this configuration, as described in the above-described examples, the sheet can be conveyed to the image forming device for a long period of time.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeder comprising:

an attraction body disposed facing an upper surface of a bundle of sheets including an uppermost sheet;

a charger disposed above the attraction body, the charger to charge a surface of the attraction body such that the attraction body electrostatically attracts the uppermost sheet of the bundle of sheets, a liquid supplier to supply a liquid to the attraction body, the liquid to dissolve discharge products; and a liquid remover to remove the liquid supplied by the liquid supplier from the attraction body, wherein the liquid supplier is configured to supply the liquid to the attraction body without contacting the attraction body and wherein the liquid remover is configured to remove the liquid from the attraction body by at least one of absorbing, blowing, evaporating and dehumidifying.

2. The sheet feeder according to claim 1, wherein the liquid contains water.

3. The sheet feeder according to claim 1, wherein the liquid supplier is configured to spray the liquid to the attraction body.

4. The sheet feeder according to claim 1, wherein the liquid remover is configured to remove the liquid supplied to the attraction body from the attraction body without contacting the attraction body.

5. The sheet feeder according to claim 4, wherein the liquid remover is configured to remove the liquid supplied to the attraction body by blowing.

6. The sheet feeder according to claim 1, wherein the liquid remover includes a liquid absorber as at least a surface, the liquid absorber being configured to absorb and remove the liquid from the attraction body.

7. The sheet feeder according to claim 1, wherein the liquid remover is further configured to contact the attraction body when the liquid remover removes the liquid supplied to the attraction body from the attraction body.

8. The sheet feeder according to claim 1, further comprising a moist air remover to remove moist air from an ambient atmosphere.

9. The sheet feeder according to claim 1, further comprising a liquid collector to collect the liquid removed by the liquid remover.

10. The sheet feeder according to claim 1, further comprising a controller to estimate a level of adhesion of the discharge products to the attraction body, the controller being configured to cause the liquid supplier to perform a liquid supplying operation and the liquid remover to perform a liquid removing operation when the level of adhesion of the discharge products to the attraction body is estimated to be a threshold value or higher.

11. The sheet feeder according to claim 1, further comprising a controller to cause the liquid supplier to perform a liquid supplying operation and to cause the liquid remover to perform a liquid removing operation at issuance of a power off instruction.

12. An image forming apparatus comprising:

a sheet container to accommodate the bundle of sheets;

an image forming device to form an image on the uppermost sheet fed from the sheet container; and the sheet feeder according to claim 1 to separate the uppermost sheet from the bundle of sheets in the sheet container and supply the uppermost sheet to the image forming device.

13. A method of removing discharge products, the method comprising:

counting the number of sheets fed from a sheet container via a processor;

determining, via the processor, when the count of the number of sheets fed from the sheet container reaches a threshold value;

confirming, via the processor, that a current time falls within a period of time upon determining that the count reaches the threshold;

removing the discharge products from a surface of an attraction body by supplying a liquid to the attraction body without contacting the attraction body, via a liquid supplier, to dissolve discharge products, in response to the confirming by the processor, where the attraction body is disposed facing an upper surface of a bundle of sheets; and resetting, via the processor, the count of the number of sheets fed from the sheet container in response to the discharge products being removed, wherein the liquid is further removed from the surface of the attraction body, via a liquid remover, by at least one of absorbing, blowing, evaporating and dehumidifying.

14. A method of removing discharge products, the method comprising:

counting the number of sheets fed from a sheet container via a processor;

determining, via the processor, when the count of the number of sheets fed from the sheet container reaches a threshold value;

receiving, via the processor, a turn off signal to control turning off a power supply in response to the processor determining that the count reaches the threshold;

removing the discharge products from a surface of an attraction body by supplying a liquid to the attraction body without contacting the attraction body, via a liquid supplier, to dissolve discharge products, in response to the processor receiving the turn off signal; resetting, via the processor, the count of the number of sheets fed from the sheet container in response to the discharge products being removed, where the attraction body is disposed facing an upper surface of a bundle of sheets;

resetting, via the processor, the count of the number of sheets fed from the sheet container in response to the discharge products being removed; and turning off the power supply after the resetting, based upon the turn off signal, wherein the liquid is further removed from the surface of the attraction body, via a liquid remover, by at least one of absorbing, blowing, evaporating and dehumidifying.

15. The sheet feeder according to claim 1, wherein the attraction body is sheet attraction belt.

16. The sheet feeder according to claim 15, wherein the sheet attraction belt includes a multilayer construction including a front surface layer and a back surface layer.

17. The sheet feeder according to claim 16, wherein the front surface layer is an insulating film and the back surface layer is a conductive layer.

* * * * *